US011134822B2

(12) United States Patent
Balz et al.

(10) Patent No.: US 11,134,822 B2
(45) Date of Patent: Oct. 5, 2021

(54) MOP BUCKET

(71) Applicant: ECOLAB USA INC., Saint Paul, MN (US)

(72) Inventors: Eric R. Balz, Stillwater, MN (US); Eric Gingras, Herber City, UT (US); Scott Latimer, Flower Mound, TX (US)

(73) Assignee: Ecolab USA Inc., Saint Paul, MN (US)

( * ) Notice: Subject to any disclaimer, the term of this patent is extended or adjusted under 35 U.S.C. 154(b) by 371 days.

(21) Appl. No.: 15/142,249

(22) Filed: Apr. 29, 2016

(65) Prior Publication Data

US 2016/0316988 A1 Nov. 3, 2016

Related U.S. Application Data

(60) Provisional application No. 62/155,772, filed on May 1, 2015.

(51) Int. Cl.

| | |
|---|---|
| ***A47L 13/59*** | (2006.01) |
| ***A47L 13/512*** | (2006.01) |
| ***A47L 13/58*** | (2006.01) |
| *A47L 13/24* | (2006.01) |

(52) U.S. Cl.

CPC ..... *A47L 13/59* (2013.01); *A47L 13/512* (2013.01); *A47L 13/58* (2013.01); *A47L 13/24* (2013.01)

(58) Field of Classification Search

CPC ..... A47L 13/58; A47L 13/59; B25G 3/24; B25G 3/26; B25G 1/04

USPC ..... 15/260, 264; 220/23.83, 23.86, 23.87, 220/23.88, 23.89; D32/53

See application file for complete search history.

(56) References Cited

U.S. PATENT DOCUMENTS

| | | | | |
|---|---|---|---|---|
| 877,149 A | | 1/1908 | Wetmore | |
| 2,337,319 A | | 3/1942 | Elkington | |
| 2,802,233 A | * | 8/1957 | Eberly | A47L 13/59 15/261 |

(Continued)

FOREIGN PATENT DOCUMENTS

| | | | | |
|---|---|---|---|---|
| EP | 0824008 A2 | * | 2/1998 | A47L 13/59 |
| EP | 1516575 A2 | | 3/2005 | |

(Continued)

OTHER PUBLICATIONS

Israel Patent Office, "International Search Report and the Written Opinion of the International Searching Authority, or the Declaration", issued in connection to Application No. PCT/US2016/030017, dated Aug. 23, 2016, 8 pages.

*Primary Examiner* — Laura C Guidotti
*Assistant Examiner* — Aaron R McConnell
(74) *Attorney, Agent, or Firm* — McKee, Voorhees & Sease, PLC

(57) ABSTRACT

A mop bucket includes a mop body with first and second compartments. The first compartment includes a sump region that is sized for receiving a portion of a floor care tool to best utilize the floor care tool and the contents of the mop bucket. A wringer assembly is attached to the mop bucket for cleaning the floor care tool and separating used cleaning supplies from unused. The mop bucket can include an insert for receiving the used cleaning supply to more easily dispose of the same. Tool hooks and floor sign attachments can also be included with the mop bucket such that the bucket provides all tools for use thereof.

14 Claims, 30 Drawing Sheets

(56) References Cited

U.S. PATENT DOCUMENTS

| | | | | |
|---|---|---|---|---|
| 4,161,799 | A | 7/1979 | Sorrells | |
| 4,798,307 | A * | 1/1989 | Evrard | A47L 13/58 15/264 |
| 5,974,621 | A * | 11/1999 | Wilen | A47L 13/59 15/260 |
| 6,006,397 | A | 12/1999 | Williams et al. | |
| 6,279,195 | B1 | 8/2001 | Biggs | |
| 6,779,225 | B1 * | 8/2004 | Bellarosa, III | A47J 47/18 15/260 |
| 6,976,286 | B1 * | 12/2005 | Sanabria | A47J 47/18 134/186 |
| D533,977 | S * | 12/2006 | Bensussan | D32/53 |
| 2002/0120997 | A1 * | 9/2002 | Alt | A47L 13/59 15/261 |
| 2006/0277709 | A1 | 12/2006 | Young | |
| 2007/0022559 | A1 | 2/2007 | Dalton | |
| 2010/0242992 | A1 | 9/2010 | Young | |
| 2012/0096668 | A1 * | 4/2012 | Treacy | A47L 13/59 15/260 |
| 2013/0340199 | A1 | 12/2013 | Tronconi et al. | |
| 2014/0263105 | A1 | 9/2014 | Kontorovich et al. | |
| 2018/0116899 | A1 * | 5/2018 | Schaaper | A61H 3/04 135/67 |

FOREIGN PATENT DOCUMENTS

| | | | | |
|---|---|---|---|---|
| EP | 2082676 | B1 | 1/2012 | |
| ES | 1100530 | U | 2/2014 | |
| GB | 1434169 | | 5/1976 | |
| GB | 2518450 | A | 3/2015 | |
| JP | 6323633 | A | 1/1988 | |
| JP | 7303573 | A | 11/1995 | |
| JP | 1052375 | A | 2/1998 | |
| JP | 11129911 | A | 5/1999 | |
| JP | 200070207 | A | 3/2000 | |
| JP | 2000516115 | A | 12/2000 | |
| JP | 2011524195 | A | 9/2011 | |
| KR | 20120004467 | U | 6/2012 | |
| WO | WO-2006033902 | A1 * | 3/2006 | A47J 47/18 |

* cited by examiner

MOP BUCKET

CROSS-REFERENCE TO RELATED APPLICATIONS

This application claims priority to U.S. Patent Application Ser. No. 62/155,772 filed on May 1, 2015, the disclosure of which is incorporated herein by reference in its entirety.

FIELD OF THE INVENTION

The invention relates generally to the field of floor cleaning. More particularly, but not exclusively, the invention relates to a mop bucket including receptacles for clean and dirty liquid and including features to make the floor cleaning more efficient.

BACKGROUND OF THE INVENTIONS

Mops, or more generally, floor care tools, are used generally for use in cleaning both wet and dry floors. The mop is generally immersed in a cleaning agent, such as water, liquid cleaner, detergents, solutions, or some combination of the same, and then moved about the floor to spread the cleaning agent about the floor. For example, a mop head can be made of material that can at least partially absorb or otherwise transport the liquid or cleaning agent. A bucket or other container can contain the cleaning agent. After a certain area of the floor has been cleaned with the mop, it is returned to the container for re-submersion, cleaning, straining, or some combination, wherein the process is repeated.

For example, a mop bucket could be used having one or more compartments, wherein a compartment includes a cleaning agent, and the other is used to receive gray liquid, which is the used or dirty liquid after the mop has been used to clean an area. However, the use of mop buckets can be efficient with regard to cleaning. They are not all inclusive, can be burdensome to clean, inefficient with regard to using all or most of a cleaning agent, and can be messy.

Therefore, there is a need in the art for an improved mop bucket that can provide for greater efficiency with its use and cleaning in general.

BRIEF SUMMARY OF THE INVENTION

Therefore, it is a primary object, feature, and/or advantage of the invention to overcome deficiencies in the art.

It is another object, feature, and/or advantage of the invention to provide a mop bucket that can be used with a floor care tool such that all or most of a cleaning agent in the bucket is utilized.

It is yet another object, feature, and/or advantage of the invention to provide a mop bucket that includes a hanger for connecting with a floor care sign to allow the sign to be stored on the hanger of the bucket.

It is still another object, feature, and/or advantage of the invention to provide a mop bucket with a hook for receiving a portion of a floor care tool to store the tool when not in use.

It is a further object, feature, and/or advantage of the invention to provide a wringing assembly for a mop bucket that controls the dirty liquid from the floor care tool head.

It is still a further object, feature, and/or advantage of the invention to provide a mop bucket with a spout for emptying the bucket.

It is yet a further object, feature, and/or advantage of the invention to provide a mop bucket with a handle positioned under a clean liquid compartment to aid in emptying the bucket.

These and/or other objects, features, and advantages of the present invention will be apparent to those skilled in the art. The present invention is not to be limited to or by these objects, features and advantages. No single embodiment need provide each and every object, feature, or advantage.

According to aspects of the invention, a mop bucket is provided for use with a floor care tool. The floor care tool is used to clean an area of a floor, such as by spreading a liquid cleaning agent on the floor and/or scrubbing the floor with the liquid cleaning agent. The mop bucket includes two compartments, with a first compartment storing a substantially unused amount of the cleaning agent. The floor care tool is positioned such that the head of the tool and/or bristles of the tool are at least partially submerged in the cleaning agent, and then the tool is used to transport the cleaning agent to the floor. After the area of floor has been cleaned, the tool is positioned at least partially within a second compartment of the mop bucket where the used cleaning agent is removed, such as by draining, compression, straining, or the like. The process is then repeated until the area is cleaned, at which time the dirty cleaning agent and any unused cleaning agent can be emptied from the bucket.

The bucket can include a sump region in the first compartment that is a recessed portion in the floor of the first compartment. For example, when the floor care tool includes a tool head with a reservoir above the bristles for containing an amount of liquid, the sump will allow the opening of the reservoir to be positioned lower in the compartment such that more cleaning agent will be allowed to enter the reservoir.

Additional aspects of the mop bucket include a handle formed underneath the first compartment and a spout formed as part of the second compartment. The first compartment may be shorter than the second such that emptying of the bucket is done via the second compartment. The handle allows the bucket to be raised more easily at the first compartment to control dumping out the spout of the second compartment.

The second compartment can include an insert bucket within to receive the dirty or used liquid. A wringing assembly can be used in conjunction with the insert bucket to direct the used liquid from the tool head to within the bucket. The wringing assembly can include a shielded mesh member, such as a bucket, which provides a splash guard so that mess is mitigated during cleaning of the floor care tool at the second compartment.

A hanger, such as a permanent or removable hanger, can be attached to a portion of the mop bucket. The hanger is configured to allow a floor care sign to be hung thereon such that the floor care sign is temporarily part of the mop bucket. Therefore, the sign can be ready to use when the mop bucket is used. A hook can also be included, such as extending toward the first compartment of the mop bucket. The hook can interact with a handle of the floor care tool to hold the tool in a somewhat upright position when not in use.

Figure 1:
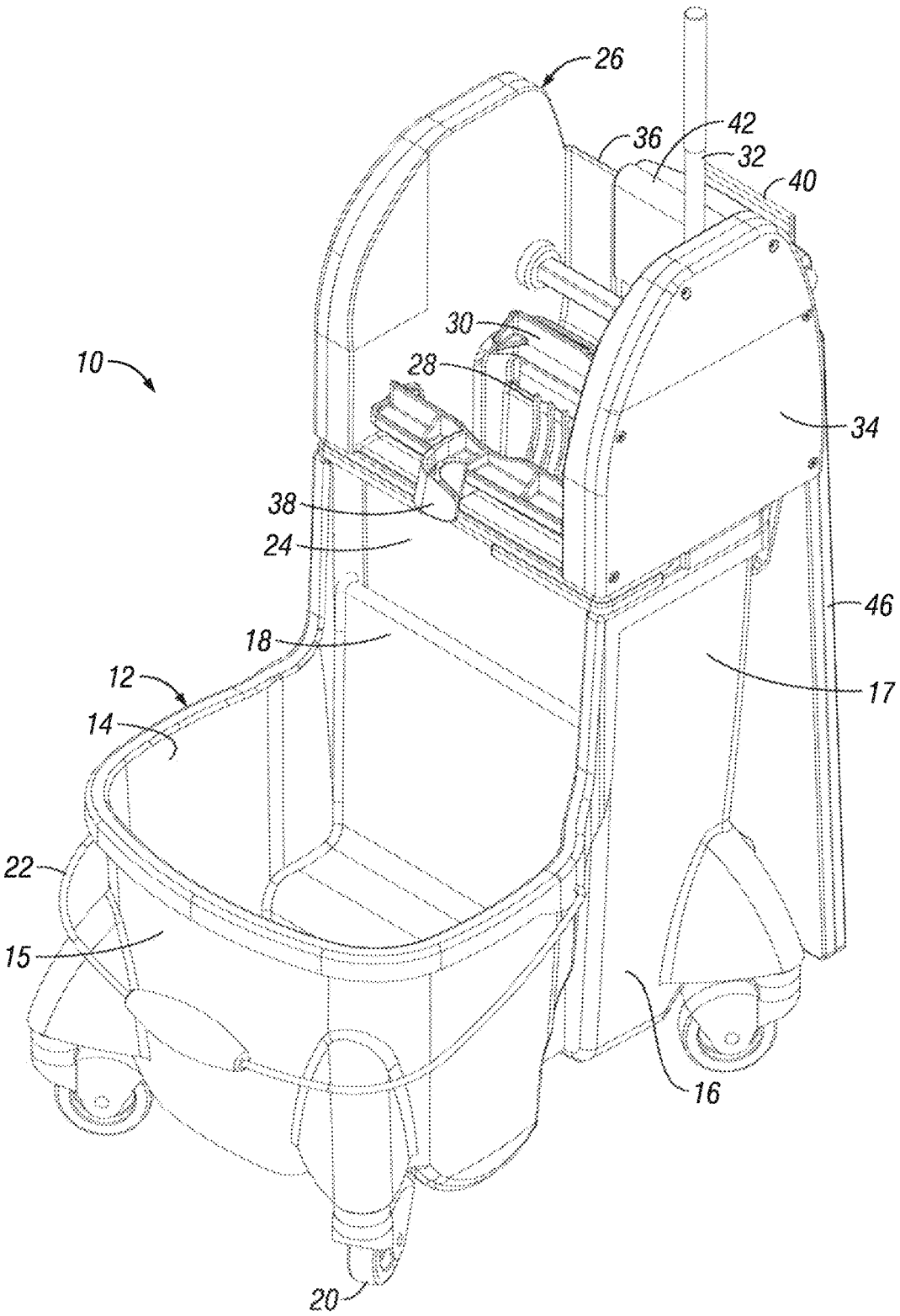
FIG. 1 is perspective view of a mop bucket according to aspects of the invention.
Figure 2:
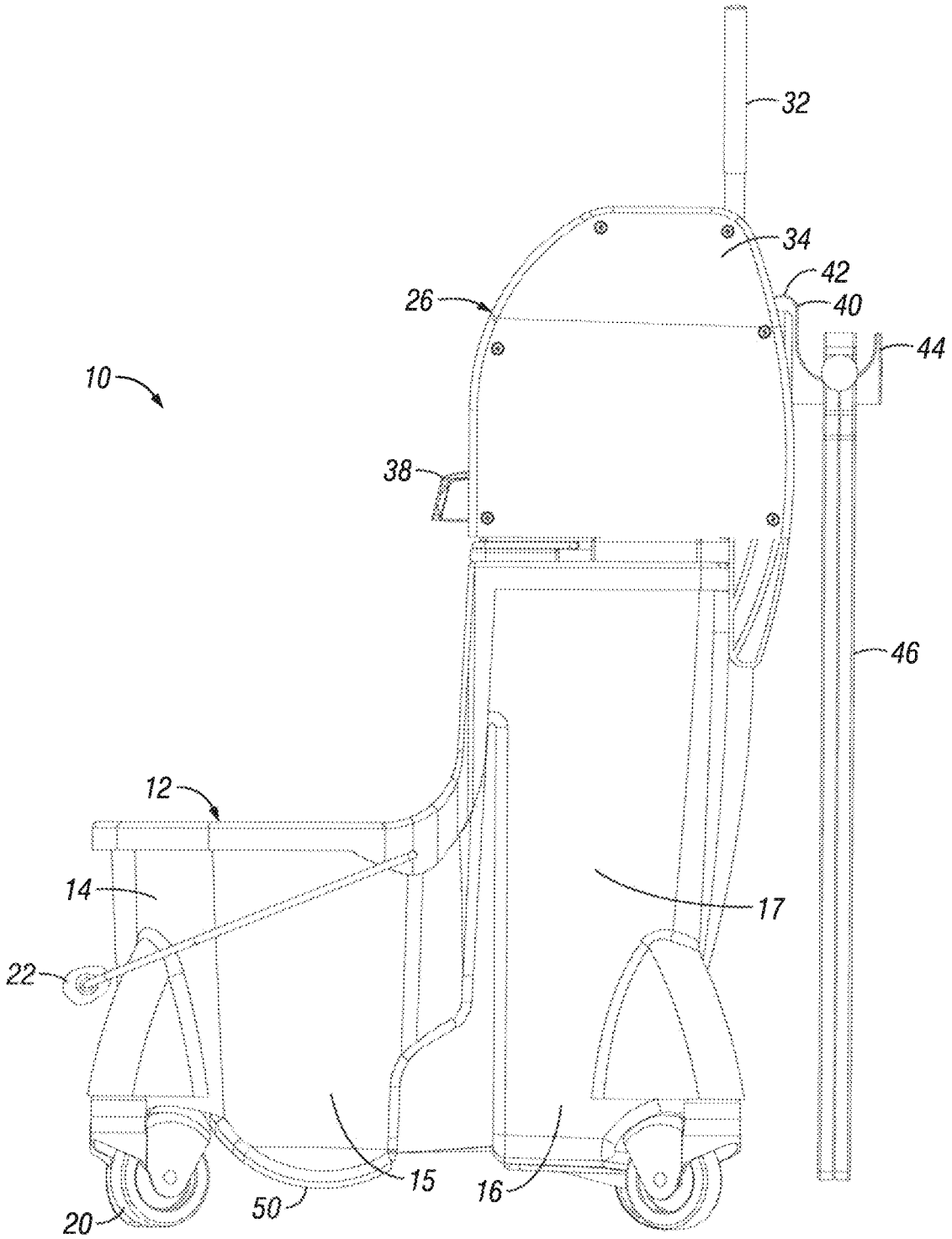
FIG. 2 is a side elevation view of the mop bucket.
Figure 3:
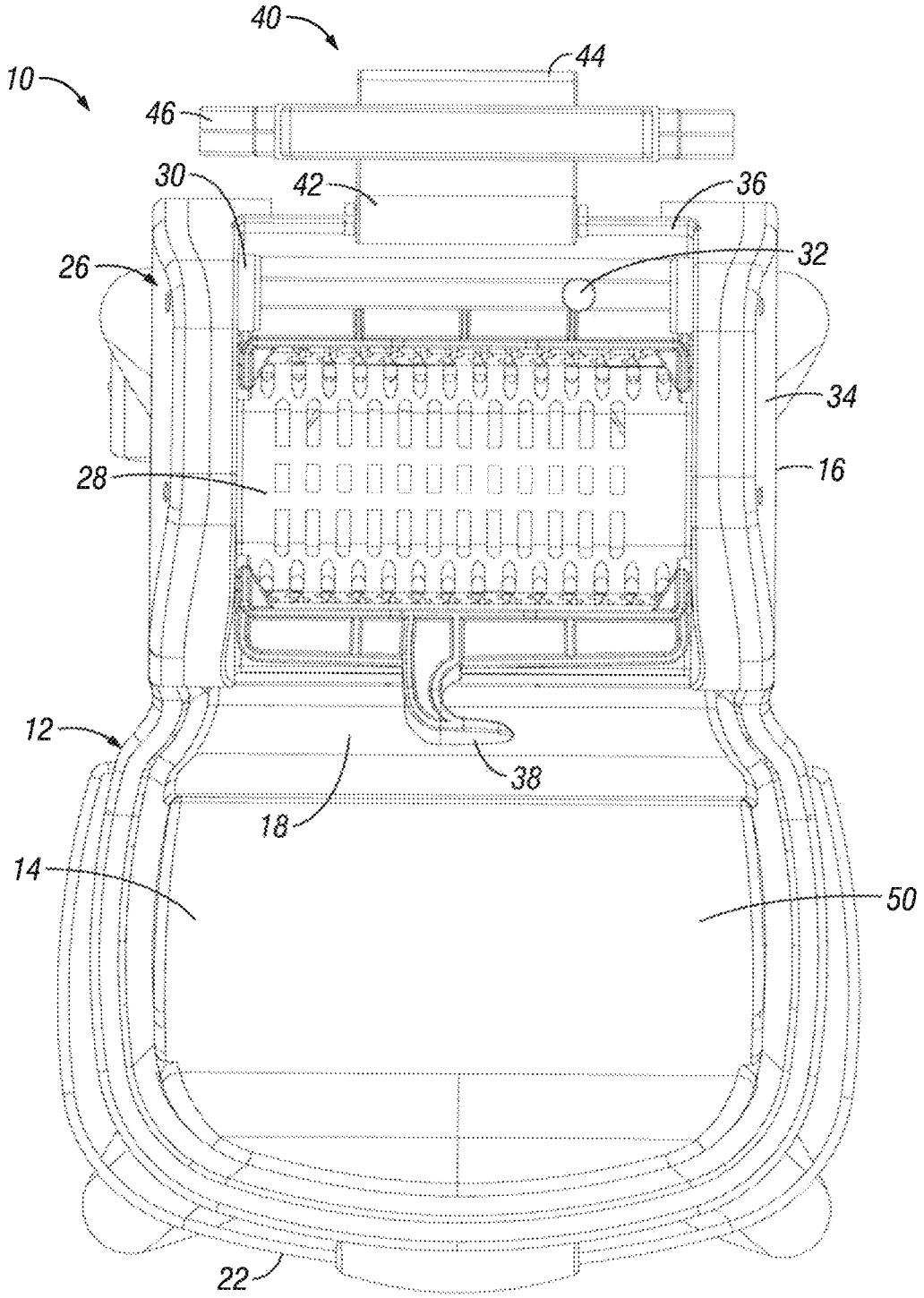
FIG. 3 is a top plan view of the mop bucket.
Figure 4:
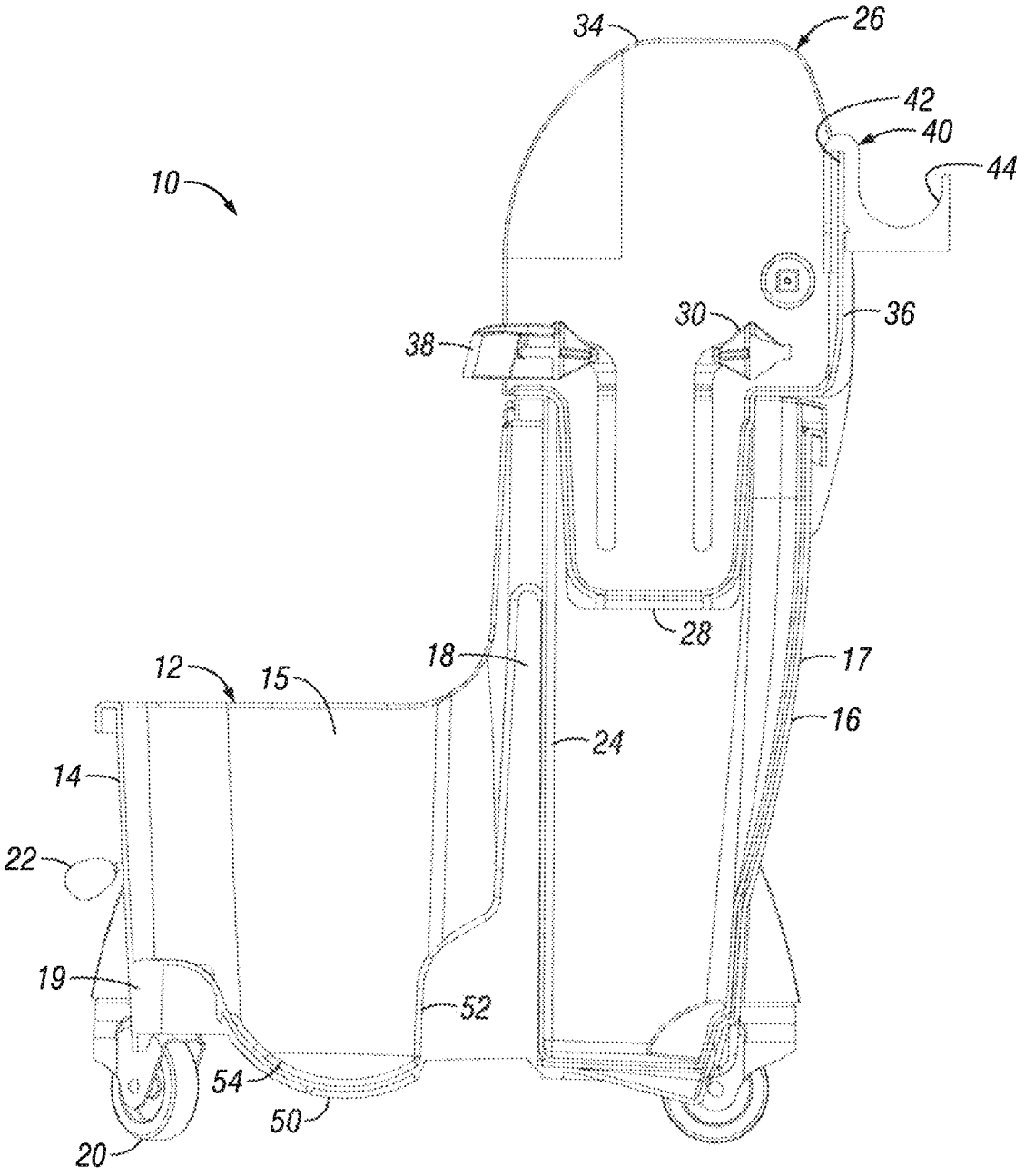
FIG. 4 is a sectional view of the mop bucket.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE INVENTION

The invention is directed generally to the field of floor care tools and other apparatuses for use with cleaning floors. For example, some floors may be commercial industries such as restaurants, hospitals, and the like. However, the invention, including the components disclosed herein, could be used in a household residence as well. As will be understood, the invention provides numerous advantages and allows for more efficient cleaning of various types of floors.

As is shown in the figures, a mop bucket 10 is provided. FIGS. 1-6 show the mop bucket 10, including many of the unique aspects of the invention. For example, the mop bucket 10 includes a mop bucket body 12 which is separated into a first compartment 14 and a second compartment 16. The first compartment 14 includes upstanding walls 15 forming the compartment. The second compartment 16 includes upstanding walls 17 forming said second compartment. The first and second compartments 14, 16 share a wall 18 positioned generally therebetween. The height of the walls 15, 17, 18 can be varied, but are shown in the figures such that the first compartment has shorter walls than the second compartment.

The first compartment 14 may be known as the clean side of the mop bucket 10. For example, a cleaning agent, such as a solution of water and an agent of cleaning, such as detergent, soap, or the like, can be added to the first compartment 14. A mop or other floor care tool is inserted into the cleaning agent in the first compartment 14 and then is used to spread the cleaning agent on the floor for cleaning. The floor care tool interacting with the surface will then need to be rinsed out to remove any of the used cleaning agent(s) that is still included with the floor care tool. Therefore, the second compartment 16 includes a reservoir for receiving the used or dirty cleaning solution to store until such time that it can be emptied from the mop bucket 10. As will be understood, the floor care tool can be manipulated by components of the mop bucket 10 to aid in removing as much used or dirty solution from the floor care tool as possible. Therefore, once the floor care tool is re-submerged in the cleaning agent of the reservoir of the first compartment 14, there will be little or at least mitigated contamination of said cleaning liquid.

Additional components of the first compartment 14 include a sump 50 formed in a bottom portion of the reservoir of the first compartment 14. As is shown best in FIG. 4, the sump 50 is positioned in the lower wall or floor of the first compartment reservoir 14 and is shaped differently than the rest of the reservoir. For example, the sump 50 includes a generally vertical wall or section 52 and a curved portion 54. As will be understood, the sump 50 formed in the floor of the first compartment reservoir 14 will allow a floor care tool to be submerged at a lower point than the rest of the first compartment 14, which will allow a reservoir of a floor care tool to be positioned lower such that it can be filled with more of the cleaning agent stored in the first compartment 14. This is advantageous as it will allow for more cleaning agent to be used in the first compartment without wasting said cleaning agent. The sump portion 50 of the first compartment 14 allows for a floor care tool to get low enough to fill even with low amounts of liquid cleaning agent in the mop bucket 10.

Still further components of the first compartment 14 include a front wall grip 19. This is shown best in FIG. 4. The front wall grip 19 is a portion of the mop bucket body 12 that allows a user to grip the front wall of the front compartment, which allows for easier emptying of the mop bucket. For example, once a floor has been cleaned using the mop bucket 10 and the second compartment 16 includes an amount of used or dirty cleaning agent, the mop bucket will need to be emptied of the cleaning agent so that it can be cleaned and/or used at a later time. In order to prevent or otherwise mitigate contamination of the cleaned first compartment 14, it may be desirable to dispose of the used cleaning agent via the back wall of the second compartment 16. The front grip 19 will allow a user to lift at said front grip 19 in order to tip the mop bucket 10 towards the back wall of the second compartment 16 such that it can be emptied therefrom. Additional aspects in helping the dispensement of the liquid via the second compartment include a spout 21 formed as part of the second compartment. The spout 21 will allow the used cleaning solution to be dispensed in a controlled manner such that the liquid will not be prone to spill or otherwise create problems.

Still other features of the mop bucket 10 include a plurality of wheels or castors 20 positioned on the underside of the mop bucket body 12 to allow for easy movement of the mop bucket 10. A handle 22 is also included to allow for lifting, moving, dispensing, or otherwise manipulating the mop bucket 10 as required.

Figure 5:
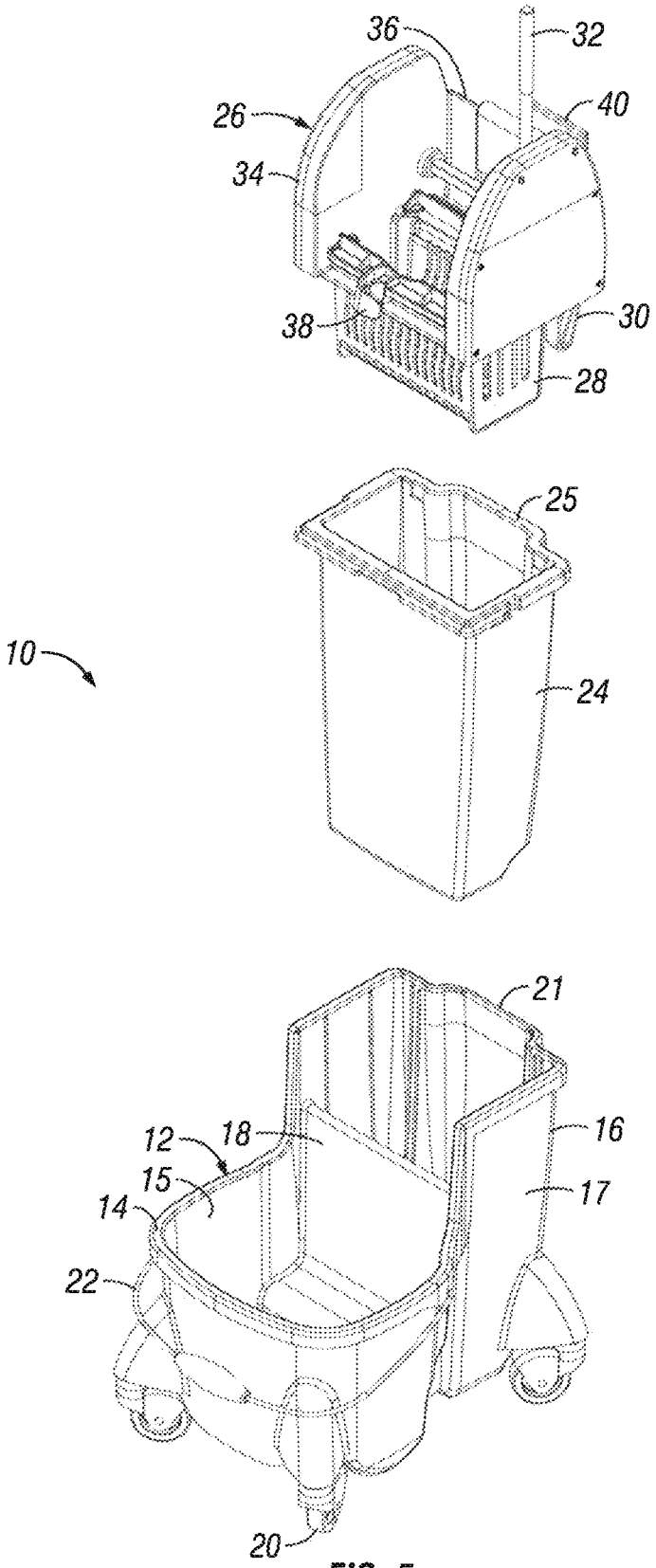
FIG. 5 is a perspective, exploded view of the mop bucket.
Figure 6:
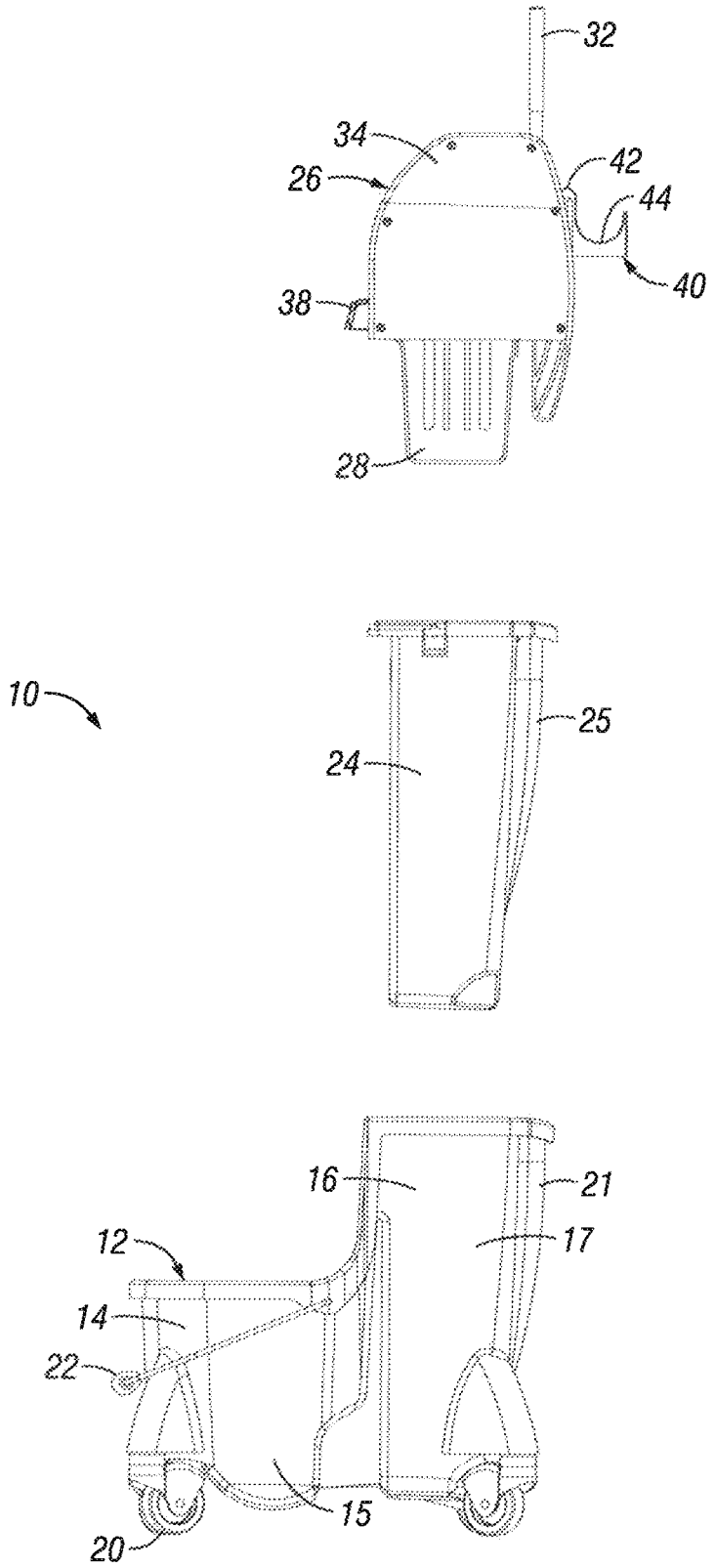
FIG. 6 is a side exploded view of the mop bucket.

While the mop bucket 10 can be used with the first and second compartments 14, 16 only, the invention also contemplates the use of additional inserts positioned within components of the mop bucket 10. For example, as shown in the figures, an insert bucket 24 is shown to be positioned generally within the second compartment 14. The insert bucket 24, as is shown best in FIGS. 5 and 6, is shaped similarly to the shape of the interior reservoir of the second compartment 16 such that it can be easily inserted and removed therefrom. However, the height of the insert bucket 25 may be larger than that of the second compartment 16 such that more used or dirty solution can be stored therein, and can be stored in a way such that spilling is mitigated. The insert bucket 24 includes upstanding walls and may have a lip for resting upon a top surface of the second compartment 16. Furthermore, as is shown in FIG. 5, the insert bucket 24 also includes a spout portion 25 formed in a back wall thereof to promote efficient dispensing of the used liquid from the insert bucket 24. Thus, the insert bucket may be easily insertable within the second compartment and easily removed for dumping separately or for dispensing of the liquid while still positioned within or at least partially within the second compartment 16.

Also shown in the figures is a wringer assembly 26 which is positioned at least partially within the second compartment 16 and/or the insert bucket 24. For example, the wringer assembly 26 is shown to be positioned within the insert bucket 24 in the figures, however, it is to be appreciated that when the insert bucket is not used, the wringer assembly 26 can be positioned directly in, on, or some combination thereof in relation to the second compartment 16.

The wringer compartment 26 includes a wringer basket 28, which may be a mesh bucket, wringer paddle 30 with a handle 32, sidewall 34, and a rear wall 36. The wringer basket 28 provides for a shielded wringer that is used as a splashguard for cleaning the floor care tool after use thereof. For example, when a mop is used with the mop bucket 10, the mop can be positioned in the mesh bucket pressed there against to aid in removing excess cleaning solution therefrom and into the storage compartment of the insert bucket 24 before acquiring new cleaning solution from the first compartment 14. The wringer basket 28 can include holes, slots, or other apertures that can be sized and oriented to direct the solution from the floor care tool in a generally downwards direction so that it is stored in the mop bucket and not splashed outside of the same. The apertures of the basket 28 can also be oriented to direct the used liquid in a sideways manner. For example, when an insert bucket 24 is not used, there may be a gap or open portion of the wall 18 between the first and second compartments. The apertures of the basket 28 can direct the used solution away from the gap and towards the side walls or rear wall of the second compartment 16 in order to prevent or otherwise mitigate cross-contamination of the used and clean solutions.

The wringer or moving paddle 30 can be used in conjunction with said wringer basket 28 to further aid in the removal of the used cleaning solution from the floor care tool. The wringer 30 includes moving paddles that, when manipulated by the handle 32, will move against one another to compress the floor care tool head, which aids in ridding the floor care tool head of excess and/or used cleaning solution. The handle 32 can then be manipulated to open the moving paddles to allow for removal of the mop head from the wringer basket 28. The sidewalls 34 of the wringer assembly 26 provide for protection from splashing or otherwise spilling any excess cleaning solution.

A tool hook 38 is shown in the figures to be extending generally frontward (with the first compartment 14 being the front of the bucket 10) from the wringer assembly 26. As is shown, the tool hook 38 may be formed, molded, or otherwise integrated with the wringer assembly 26. The tool hook as shown extends at least partially towards the first compartment 14 of the mop bucket 10. The hook 38 is configured to receive a portion of a handle of a floor care tool for use with the mop bucket 10. Thus, when the floor care tool is not in use, the tool can be stored within the mop bucket 10 with a portion of the handle positioned generally within the hook 38 such that the tool will not fall out of or relative to the mop bucket 10. The hook 38 provides a secure way to at least temporarily store the floor care tool. The hook 38 can be attached to the moving paddle or else can be removable relative to the shared wall 18, wringer assembly 26 and/or other walls of the mop bucket and components thereof. The removability of the tool hook 38 will allow for greater flexibility for use with the mop bucket 10.

Also shown in the figures is a sign hanger 40 positioned generally at the rear wall 36 of the wringer assembly 26. The sign hanger 40 is shown to be a removable member temporarily affixed to the back wall 36 of the wringer assembly 26. The sign hanger 40 includes a grip or lip member 42 which can be slid upon the rear wall 36 of the wringer assembly 26 to be friction fit on the rear wall 36. There is also a receptacle portion 44 in the form of a generally upward facing hook member that extends from the grip member 42. The receptacle member 44 is configured to be used to hang a floor sign 46 thereon.

For example, the floor sign 46 may include an aperture 48 therein, which can be positioned over the hook like receptacle 44 and rested thereon when not in use. Floor signs, such as caution signs, instructional signs, and/or other warning signs are important in alerting individuals in the area of a floor cleaning that the floor may be wet, which means a higher chance of slipping and injury. However, the floor sign need not be used at all times and it can be time consuming to have to find a sign at a separate location from the mop bucket. Therefore, the hanger 40 attached to the mop bucket 10 of the invention provides for a more efficient way of ensuring the known location of a sign that can be readily available upon cleaning of a floor.

The removability of the hanger 40 relative to the mop bucket 10 also allows for greater flexibility and use of the sign hanger. For example, if the mop bucket is to be used at a location further away from a supply area, the hanger 40 can be quickly and easily added to the mop bucket and a floor sign 46 hung thereupon to be ready for transport to the location of use of the mop bucket 10. However, when not needed, the hanger can be removed from the mop bucket.

Furthermore, the removability of the hanger 40 allows for the removal during emptying of the mop bucket. As has been disclosed, the mop bucket includes spouts at the rear of the mop bucket to aid in controlling emptying of the mop bucket. As this is in a similar location of the hanger 40, it may be desirable to remove said hanger prior to dispensing of the liquid from the mop bucket 10. The friction fit grip of the lip of the hanger 40 allows for easy removal for emptying of the bucket. Once the bucket has been emptied, the hanger can be reattached or otherwise stored in a known location.

Figure 7:
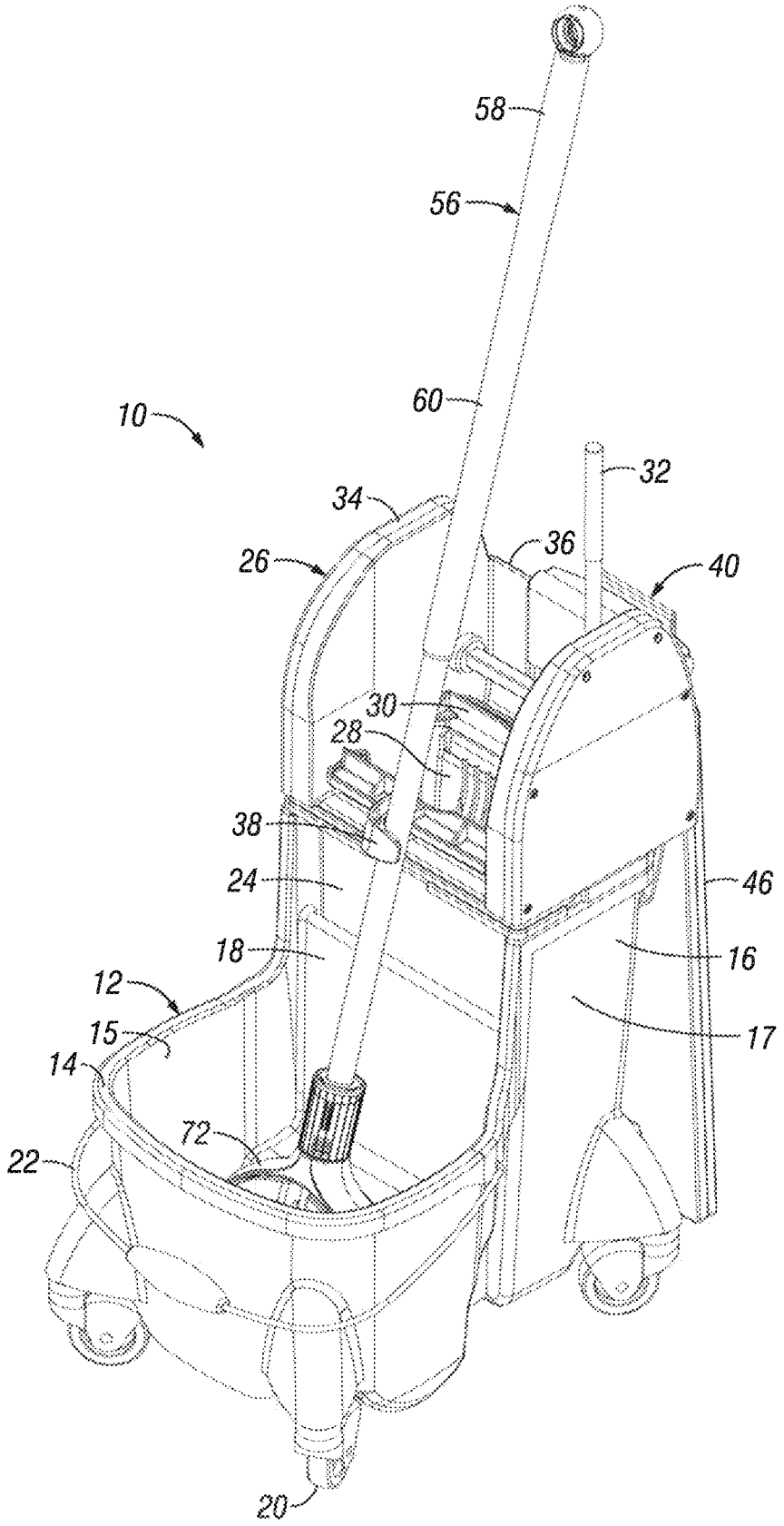
FIG. 7 is a perspective view of a mop bucket and floor care tool according to aspects of the invention.
Figure 8:
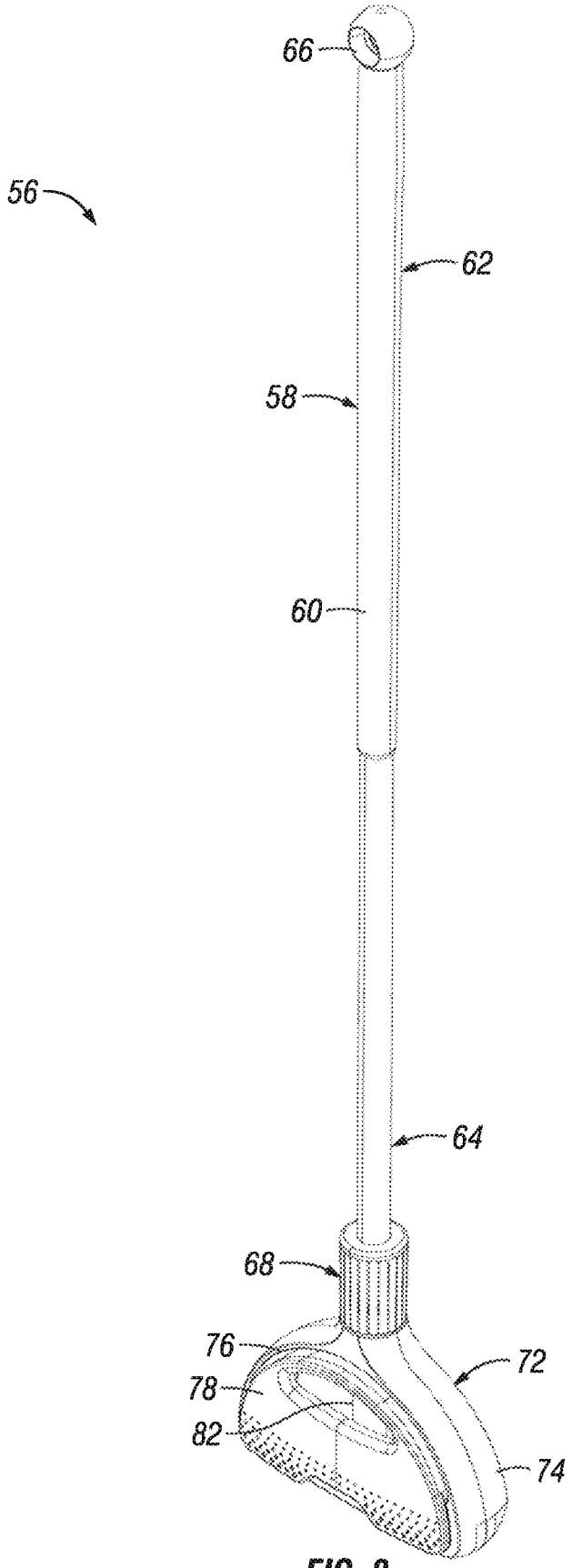
FIG. 8 is a perspective view of a floor care tool for use with the mop bucket according to some aspects of the invention.
Figure 9:
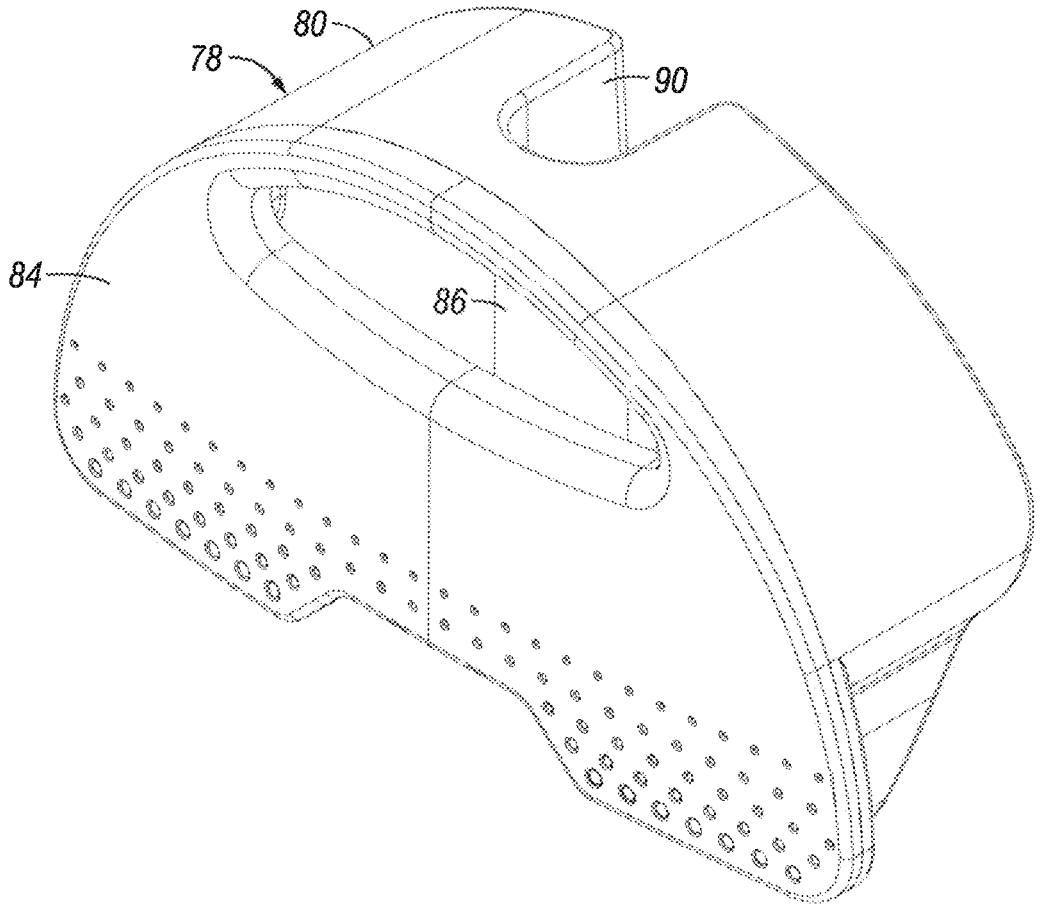
FIG. 9 is a perspective view of a floor care tool head insert or attachment for use with a tool head.
Figure 10:
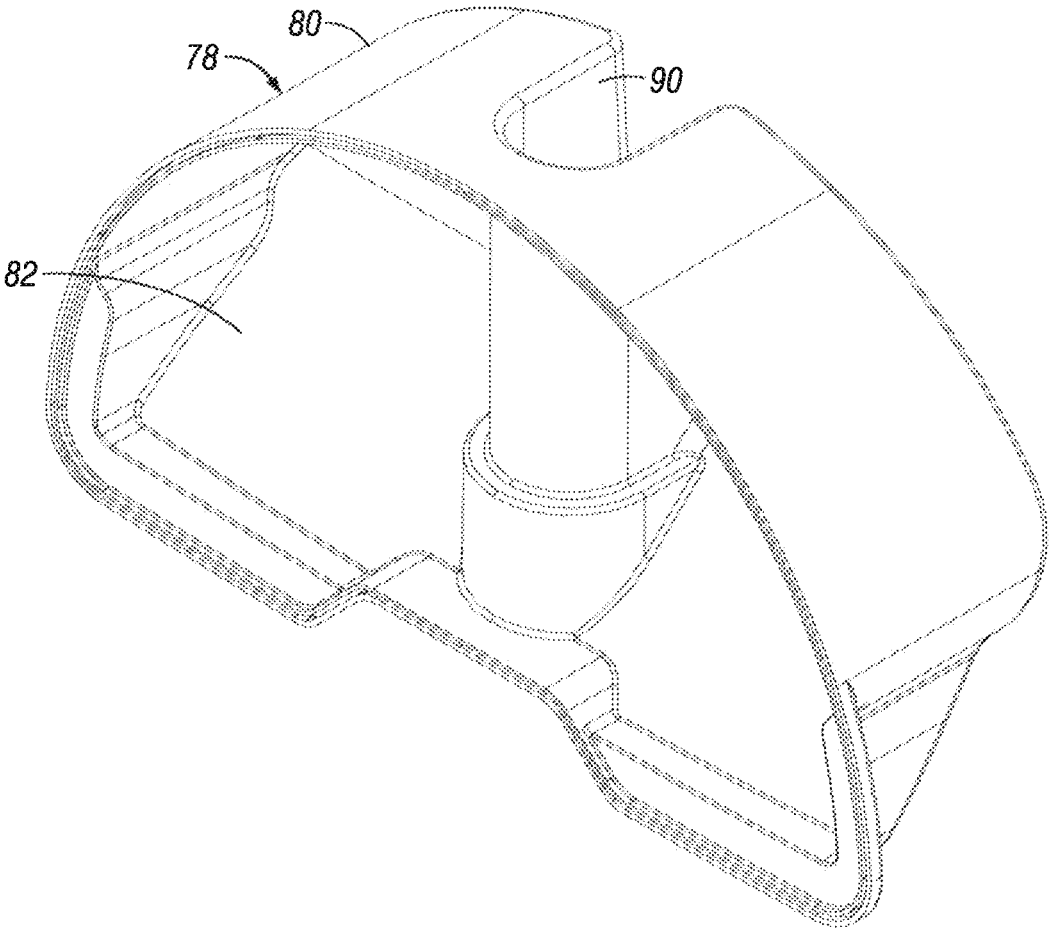
FIG. 10 is a view of the floor care tool head insert of FIG. 11 with components removed.
Figure 11:
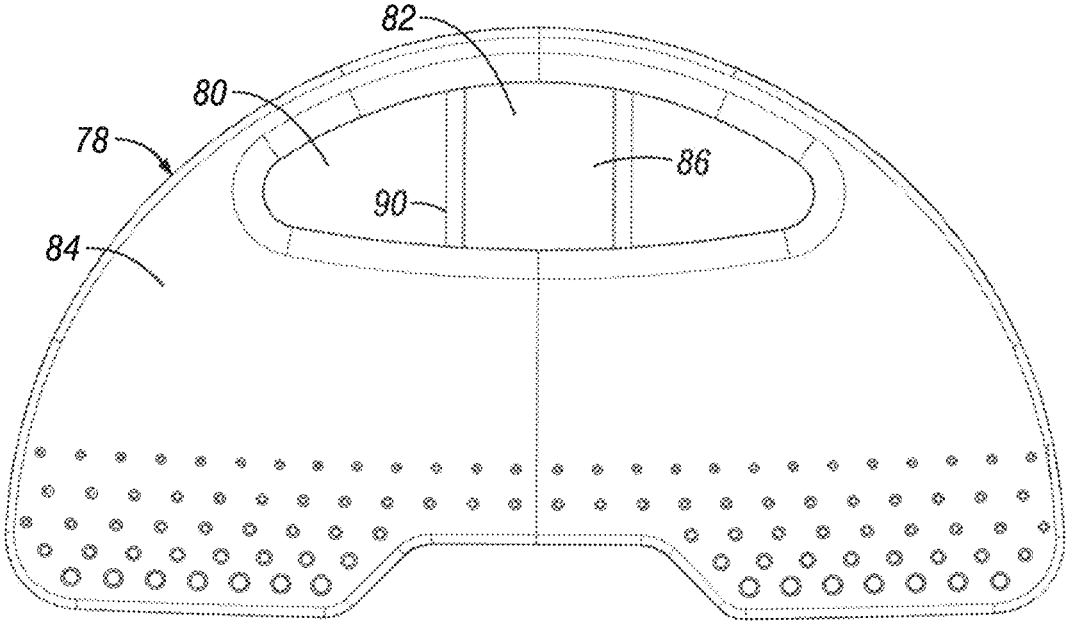
FIG. 11 is a front view of the floor care tool insert of FIG. 11.
Figure 12:
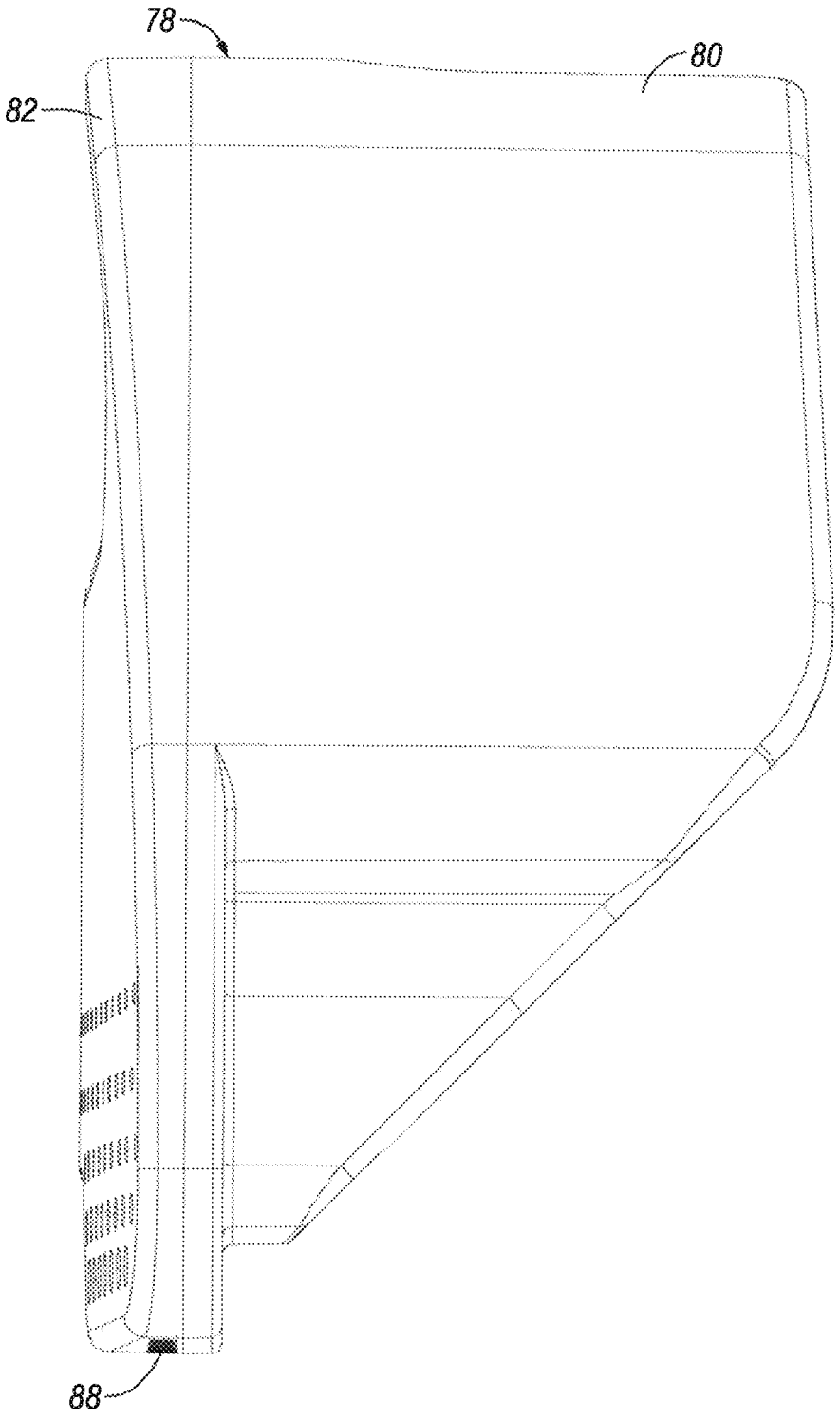
FIG. 12 is a side elevation view of the floor care tool insert of FIG. 11.
Figure 13:
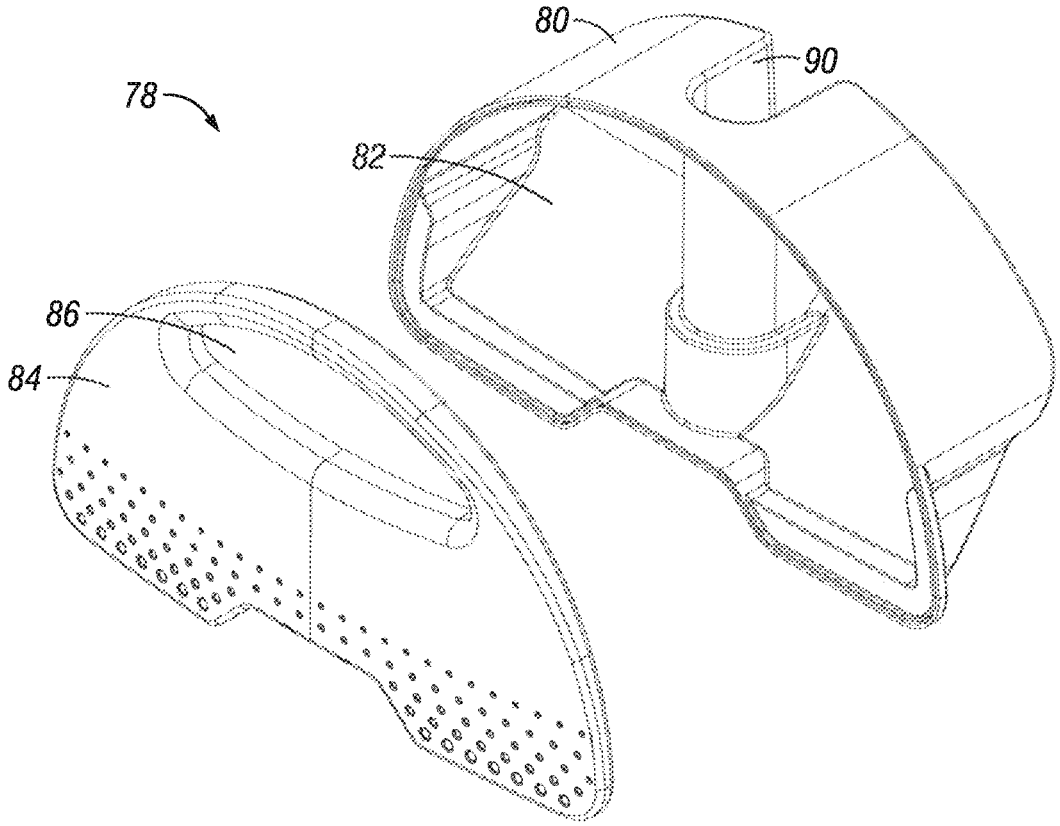
FIG. 13 is an exploded view of the floor care tool insert of FIG. 11.
Figure 14:
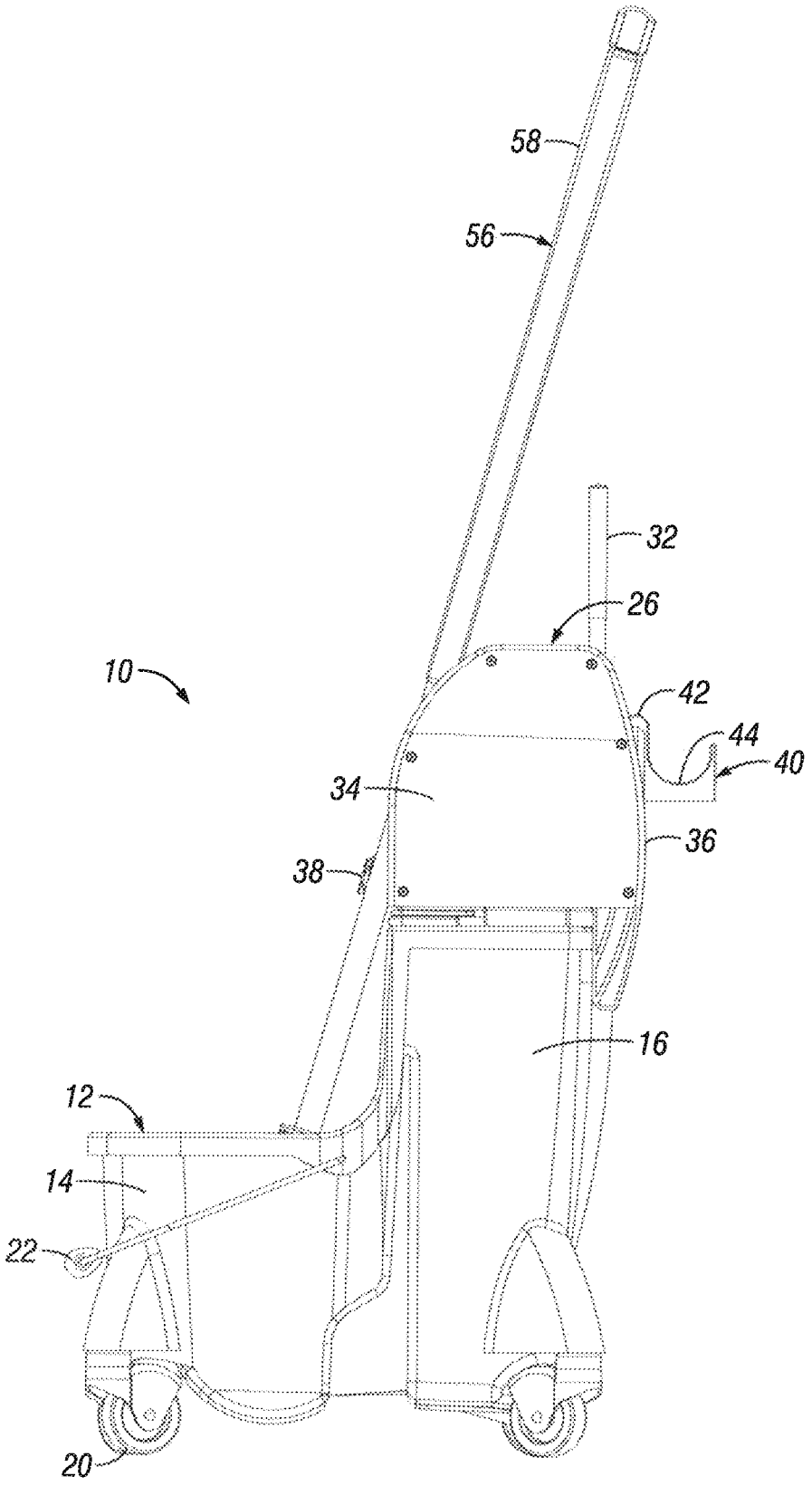
FIG. 14 is a side elevation view of the mop bucket and floor care tool.
Figure 15:
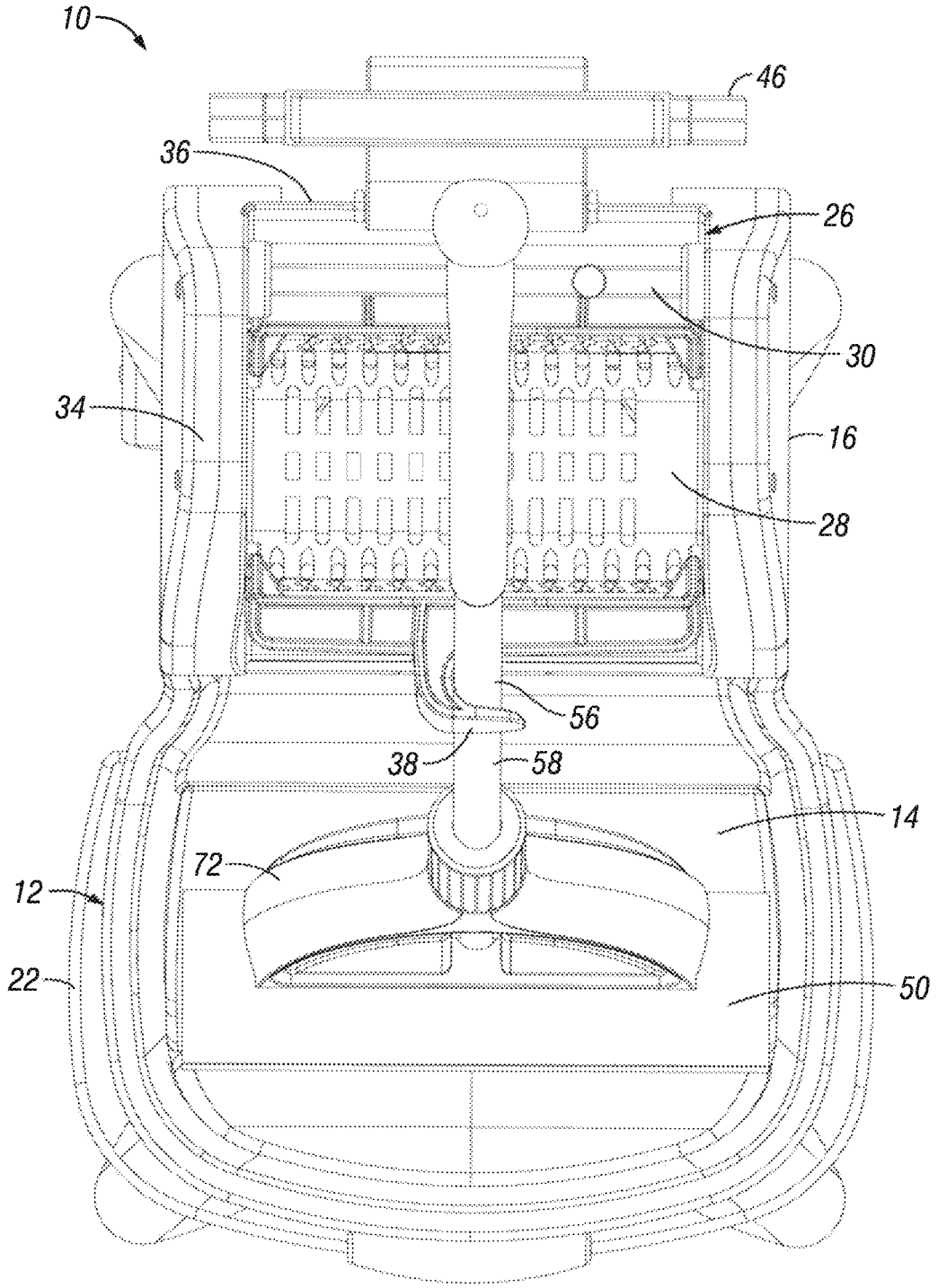
FIG. 15 is a top plan view of the mop bucket and floor care tool.

FIG. 7 shows the mop bucket 10 as has been shown and described in use with a floor care tool 56. As has been disclosed, the floor care tool can be a mop, such as a traditional mop, or other member that utilizes a liquid such as a cleaning agent for dispensing on a floor, ground, or other area for cleaning. Therefore, according to at least some embodiments and aspects of the invention, a standard mop head may be used with the mop bucket 10. However, as is shown in FIGS. 8-13 of the invention, another type of floor care tool can also be used with the mop bucket 10 of the invention. The floor care tool 56 shown in the figures is described in U.S. application Ser. No. 14/996,993, which is hereby incorporated by reference in its entirety. The floor care tool 56 includes a handle 58 with a grip portion 60, which may be an overmolded grip portion. The handle includes a first end 62 with a mounting member 66 positioned thereat. A second end 64 is also included, which includes a locking system 68 for attaching the handle to the tool head 72. The tool head 72 includes a tool head body 74 with an inner section 76. Positioned generally within the inner section 76 and attached to the tool head 72 is shown to be a floor care insert or attachment 78, which is shown to be a scoop attachment. The attachment 78 is shown in FIGS. 9-12. While there is a particular attachment shown, it is to be appreciated that other types of inserts and/or attachments can be included with the floor care tool 56. However, as shown in the figures, the insert or attachment 78 is shown to be a mop bucket style insert for use with a deck brush scoop.

The attachment 78 includes a scoop style insert for use with a deck brush bristles 92 or other mop bristles. The scoop member 78 provides a way to scope a liquid, such as a liquid solution, from the mop bucket 10 or other vessel and to distribute the liquid cleaning agent or product on the floor or other surface being cleaned. This allows for the cleaning solutions to be applied to the floor before scrubbing, and provides such in a controlled manner of application. The scoop insert 78 provides a way to control the application of the liquid product as the floor is being cleaned with the brush bristles 92 and to limit the amount of area in which the solution is applied during the cleaning. The scoop insert 78 is designed to be used with the mop bucket 10 of the invention. For example, the scoop 78 is configured to receive an amount of solution from the first compartment 14 of the mop bucket 10 when inserted there within to temporarily store an amount of solution. The solution or other cleaning agent is allowed to leak or otherwise emit from the insert 78 on to the floor surface wherein a user is able to mop, scrub, or otherwise apply the solution.

The scoop 78 includes a body portion 80 and a cover 84. The body portion 80 is a generally hollow member forming a reservoir 82 for receiving and storing an amount of cleaning solution. The cover portion 84 is configured to align with an opening of the body portion 80 to provide a cover for the reservoir 82 and to provide for filling and releasing of the cleaning agent. For example, as shown in the figures, the cover 84 includes an upper main aperture 86, and a plurality of release apertures 88. The release apertures 88 are formed by creating holes through a bottom portion of one of the body or cover portions of the insert 78. For example, a portion of the cover may be cut away such that, when joined when the body portion 80, holes exist at the seam between the two. Liquid that is stored in the reservoir is allowed to pass therethrough.

The additional circles on the front of the cover 84 may be decorative and/or functional. For example, the circles may be simply indents on the cover. According to some aspects of the invention, the circles may be apertures through the cover through which additional liquid is able to pass on to the floor.

Figure 16:
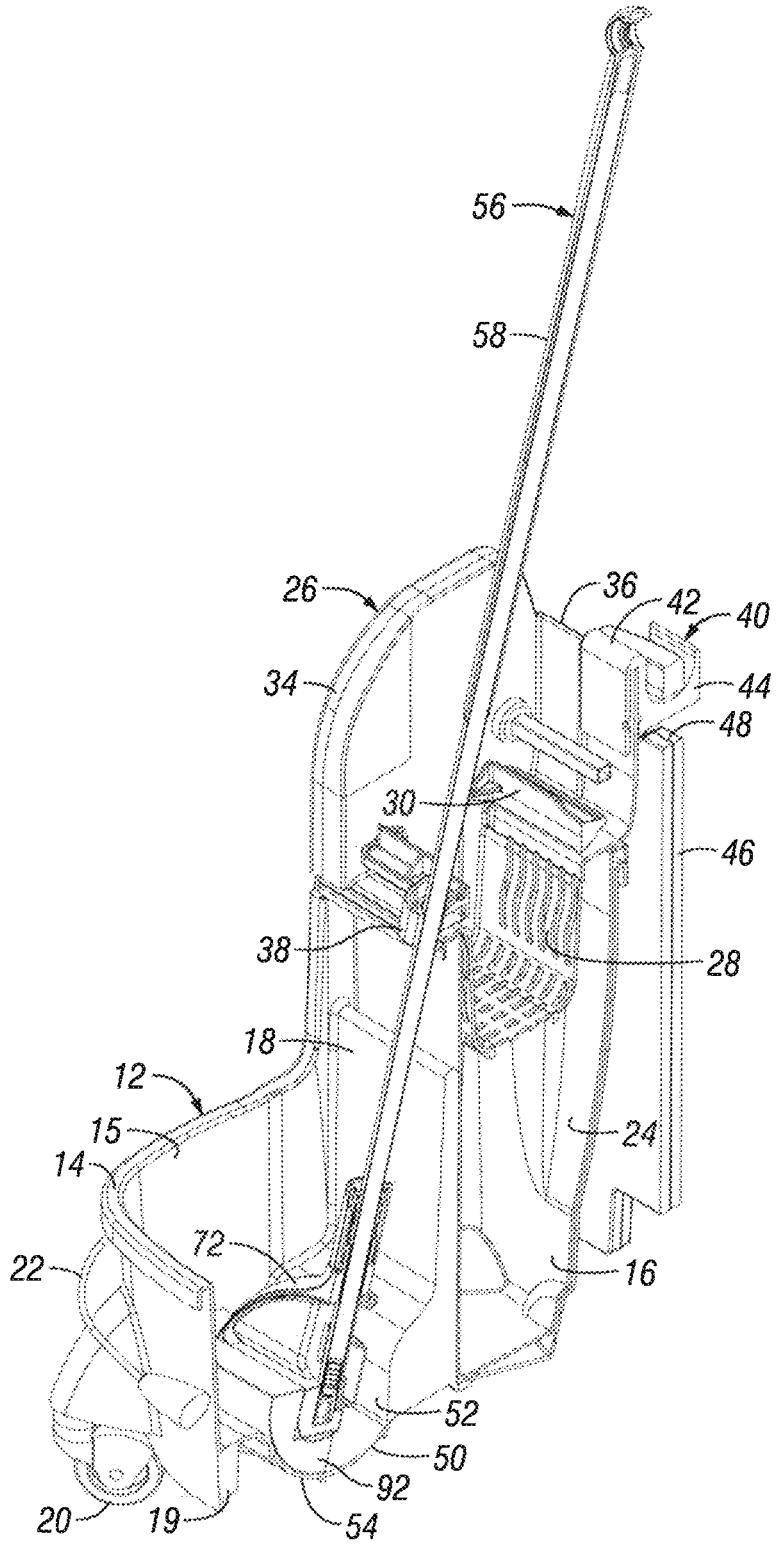
FIG. 16 is a perspective, sectional view of the mop bucket and floor care tool.
Figure 17:
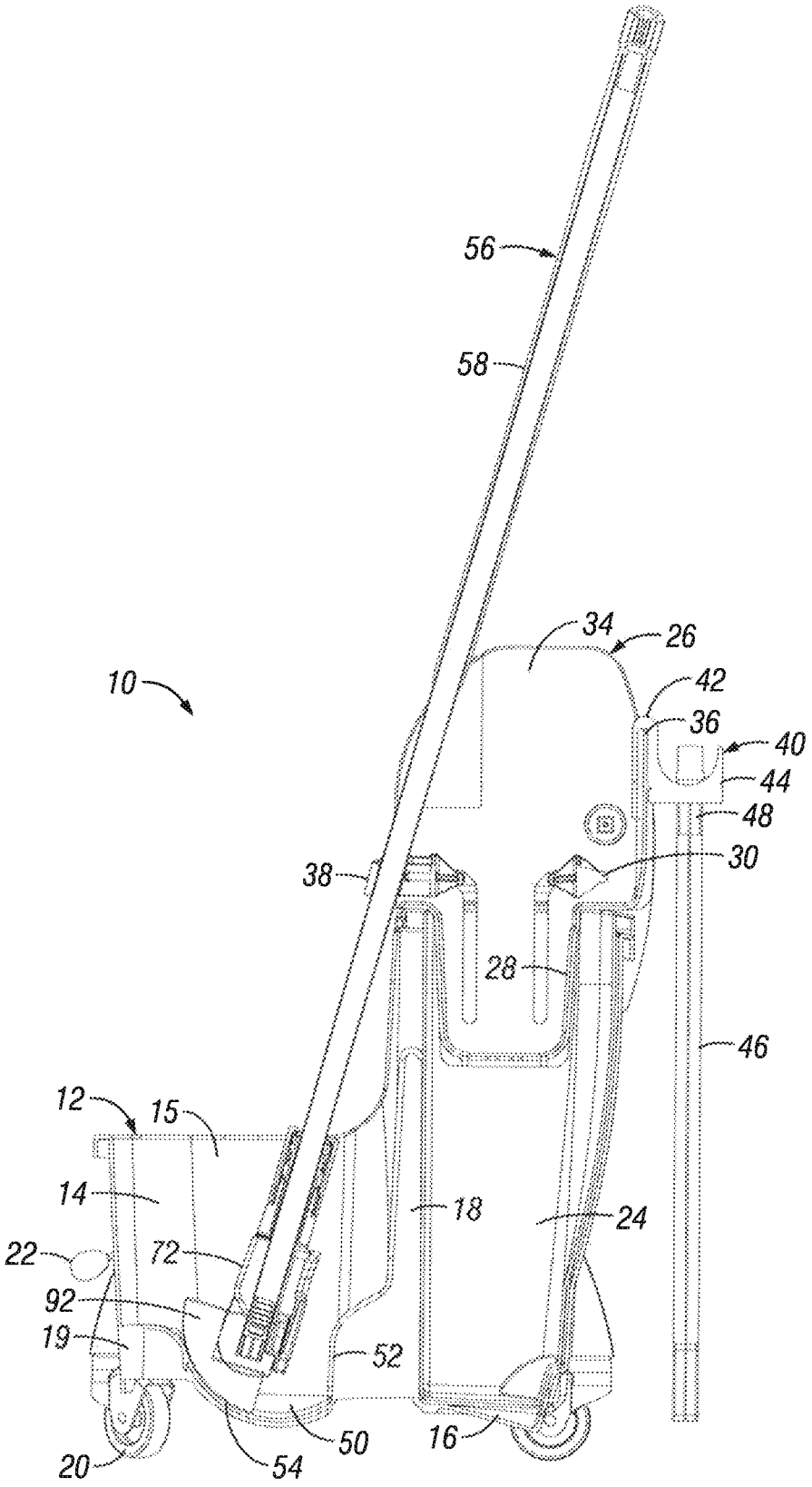
FIG. 17 is a side sectional view of the mop bucket and floor care tool.
Figure 18:
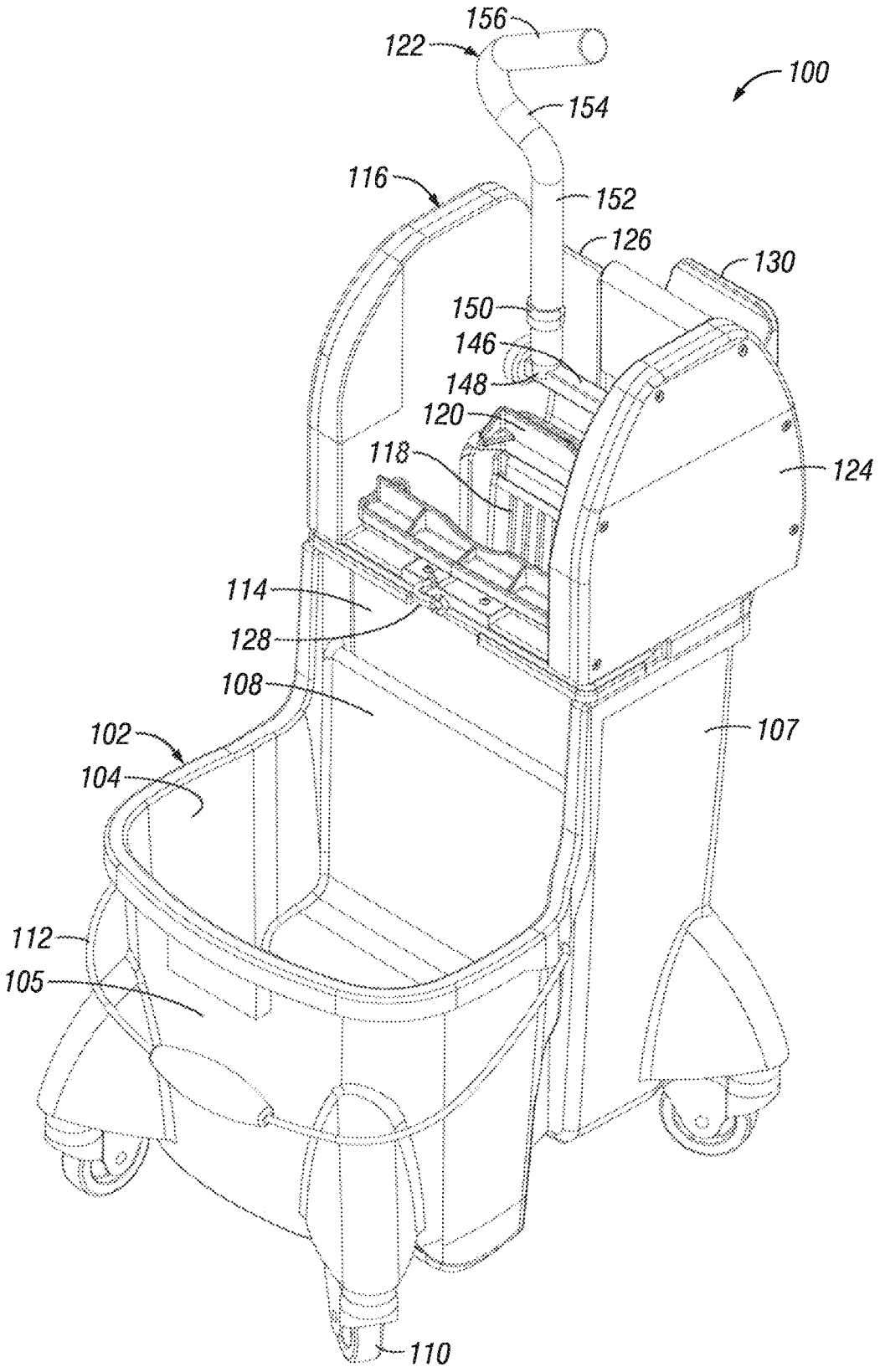
FIG. 18 is a perspective view of a mop bucket including additional aspects of the invention.
Figure 19:
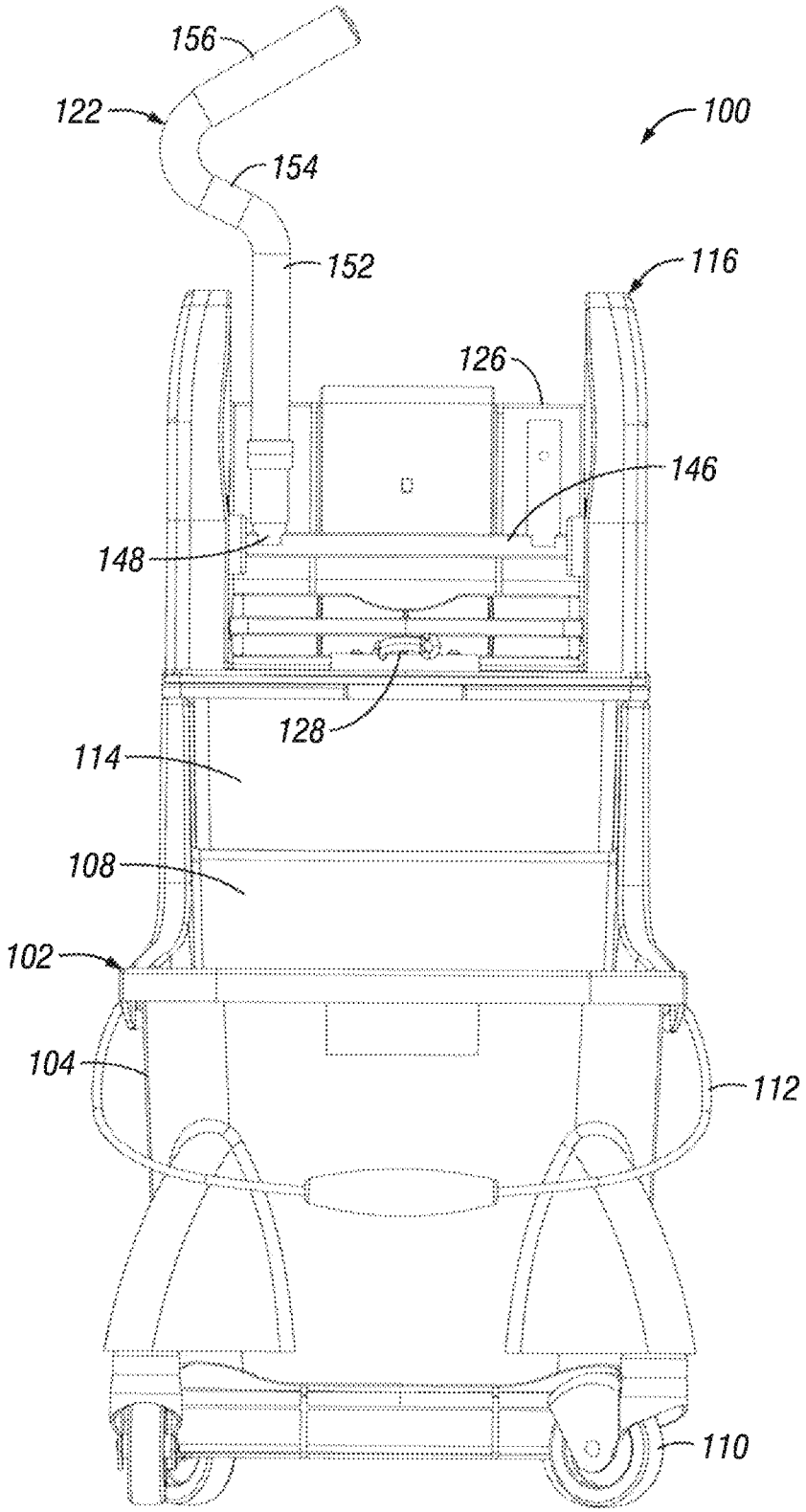
FIG. 19 is a front elevation view of the mop bucket of FIG. 18.
Figure 20:
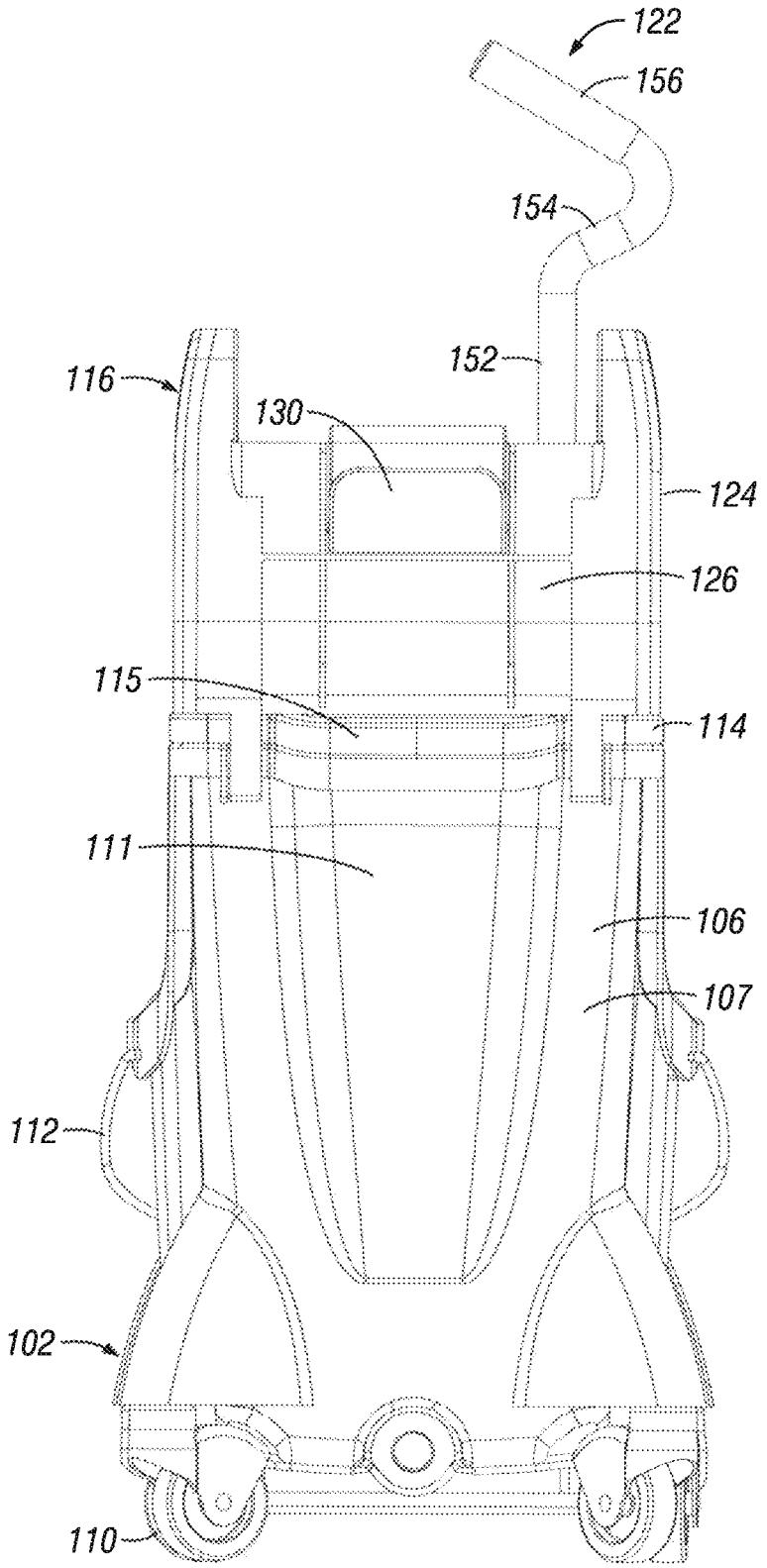
FIG. 20 is a rear elevation view of the mop bucket of FIG. 18.
Figure 21:
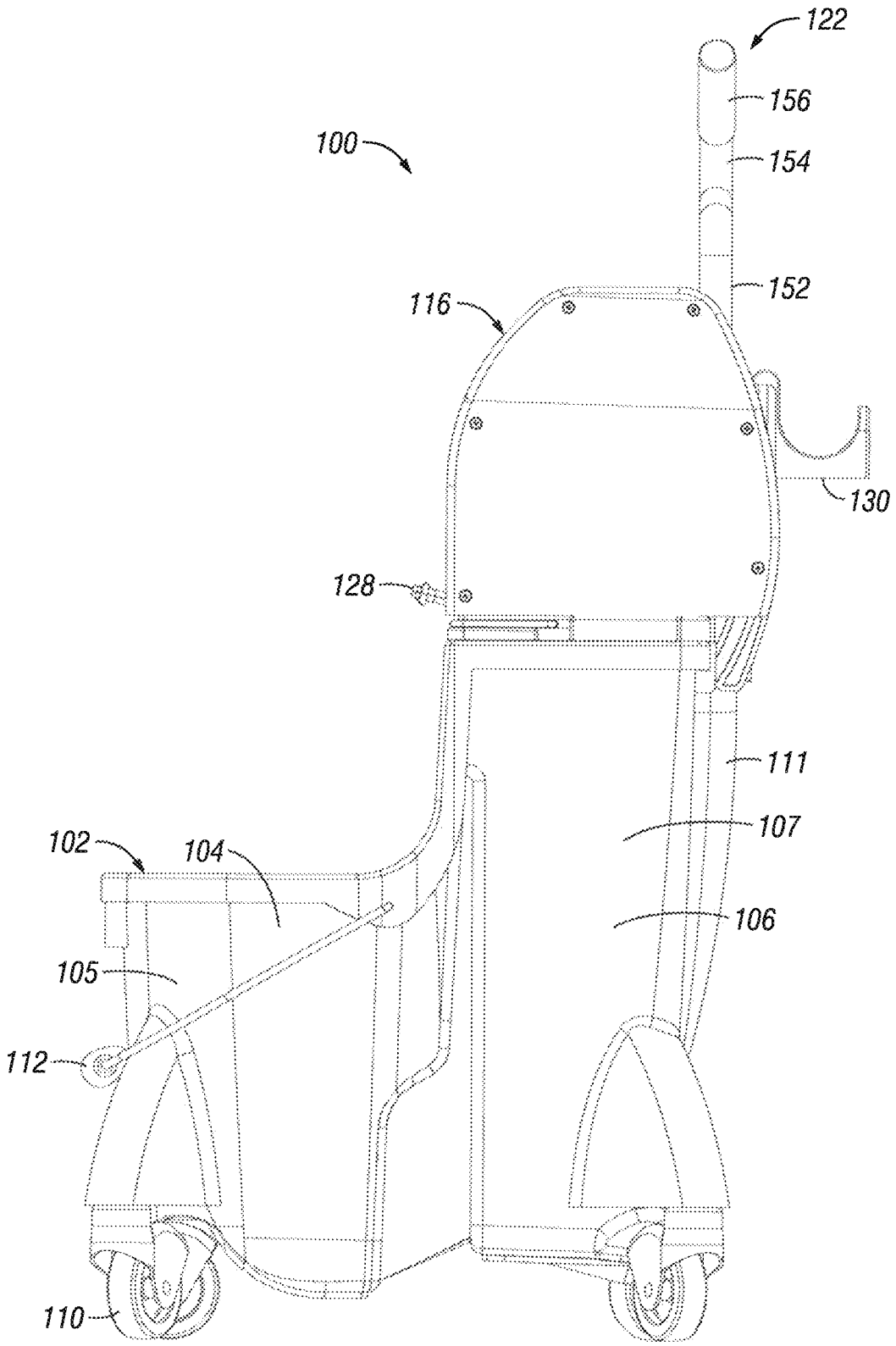
FIG. 21 is a side elevation view of the mop bucket of FIG. 18.
Figure 22:
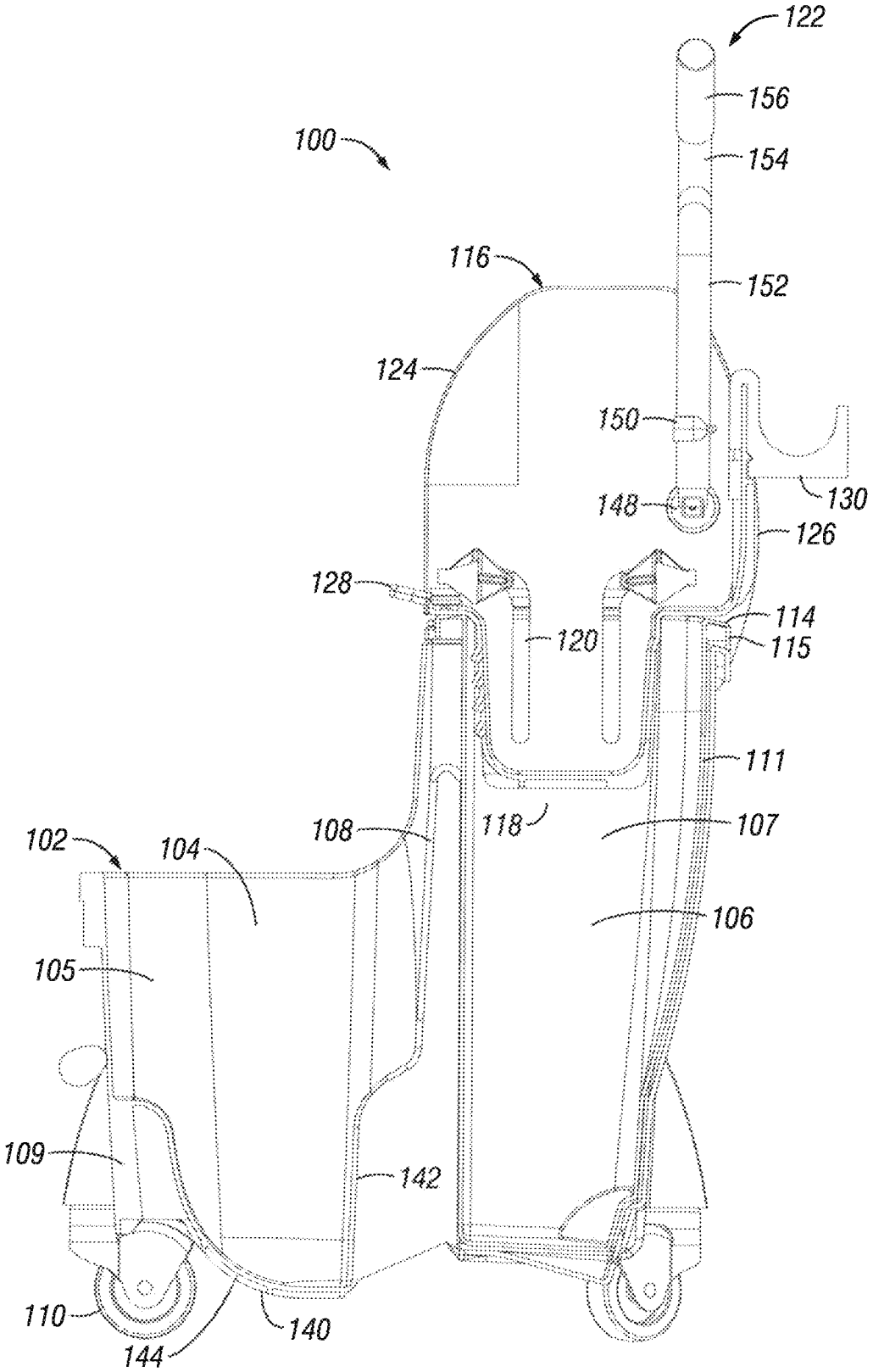
FIG. 22 is a sectional view of the mop bucket of FIG. 18.
Figure 23:
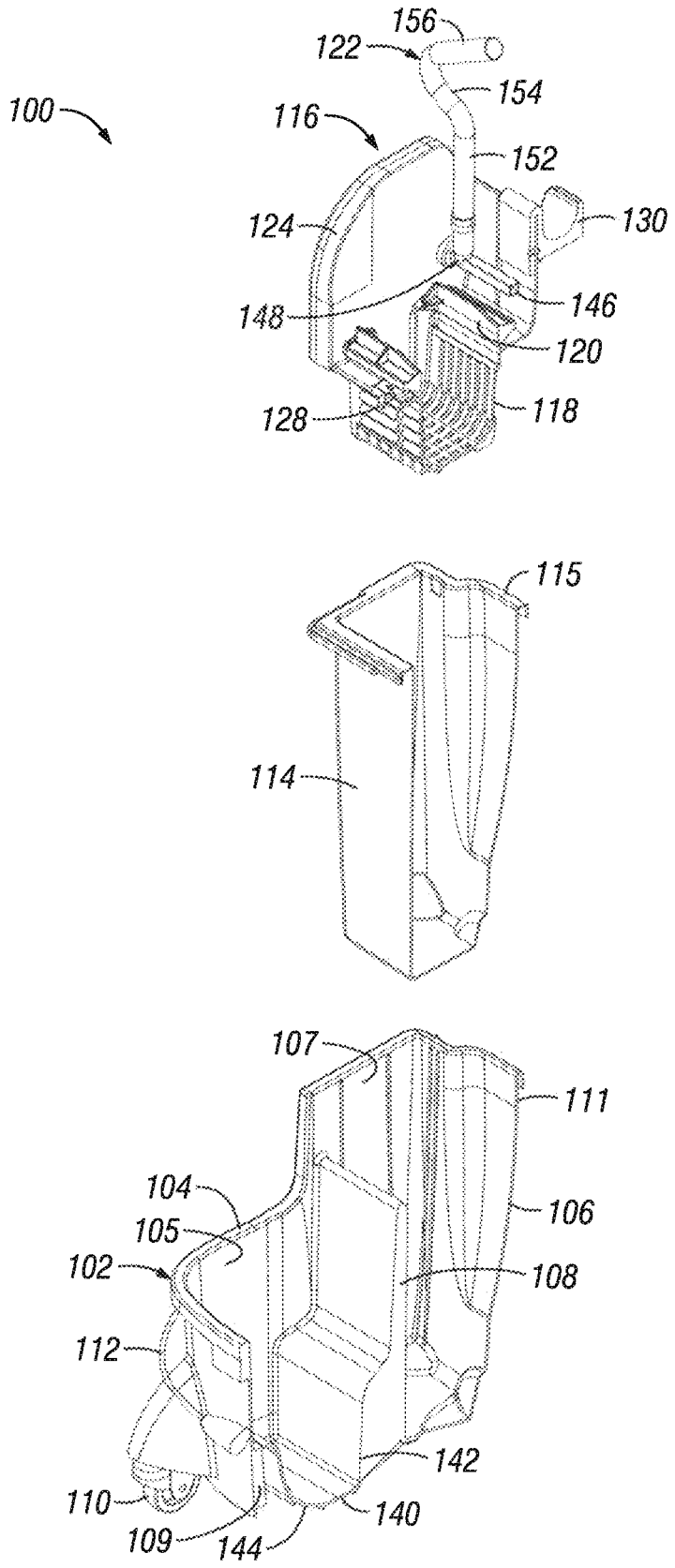
FIG. 23 is an exploded, sectional view of the mop bucket of FIG. 18.
Figure 24:
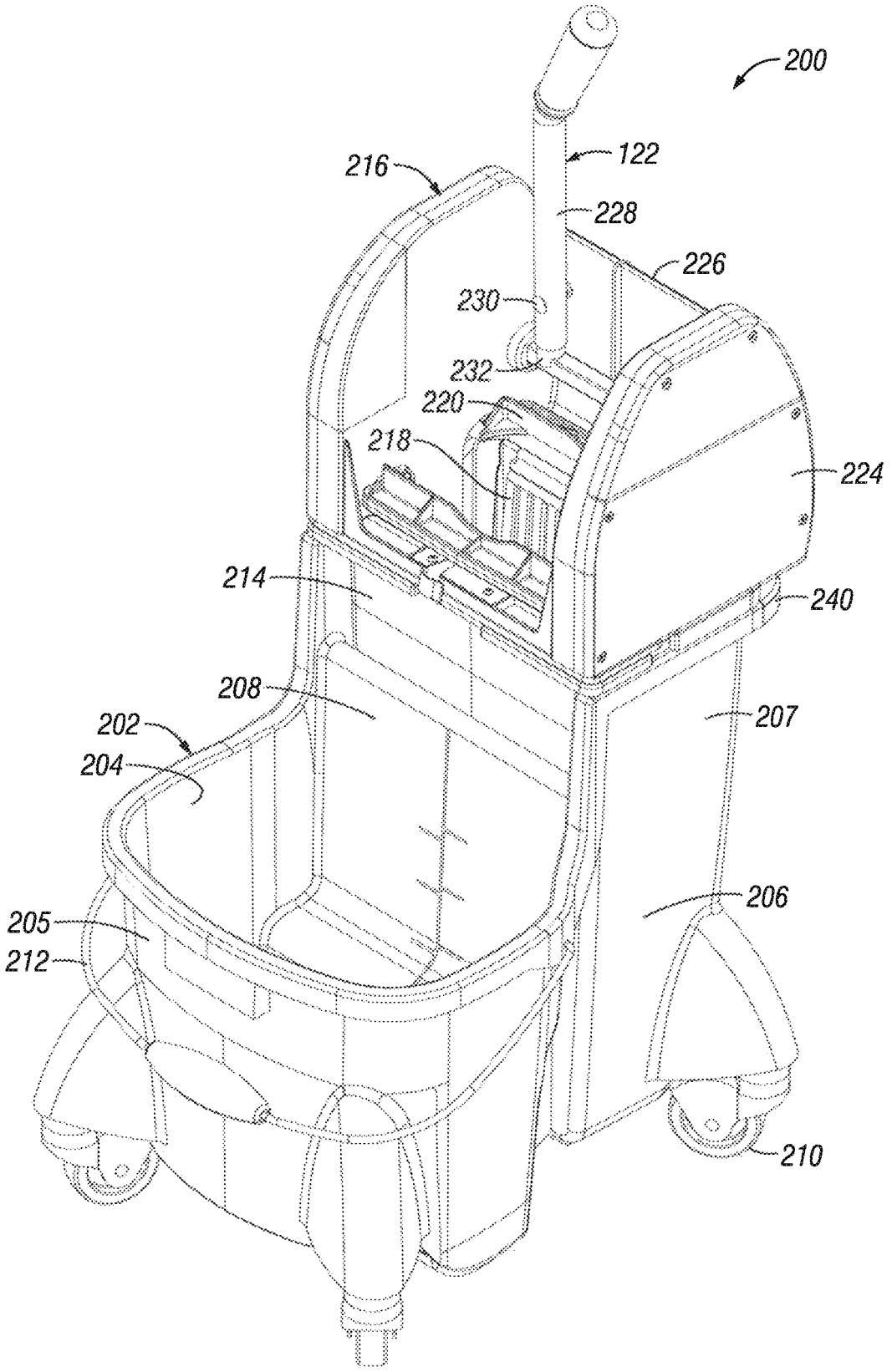
FIG. 24 is a perspective view of a mop bucket according to additional aspects of the invention.
Figure 25:
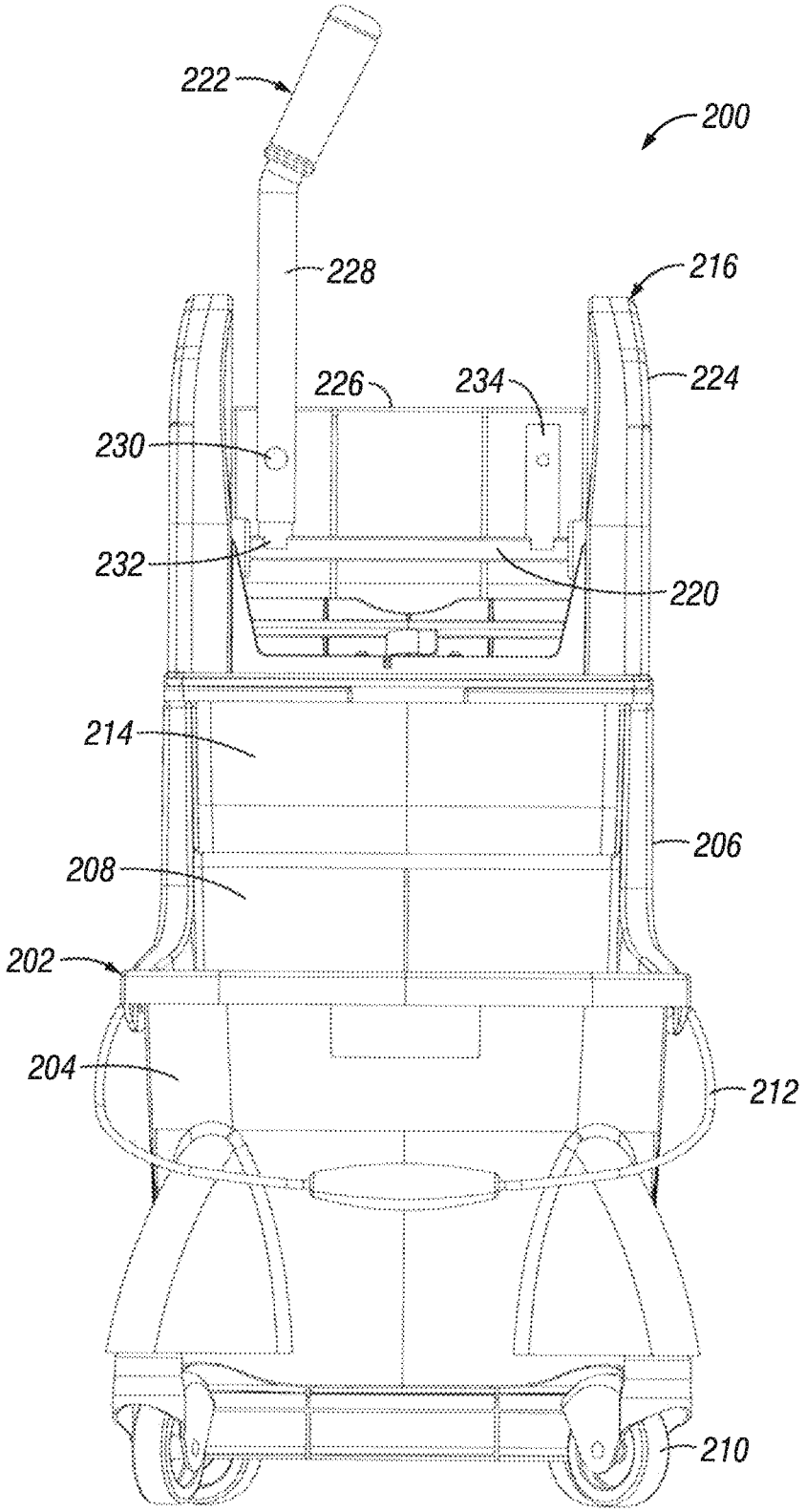
FIG. 25 is a front elevation view of the mop bucket of FIG. 24.
Figure 26:
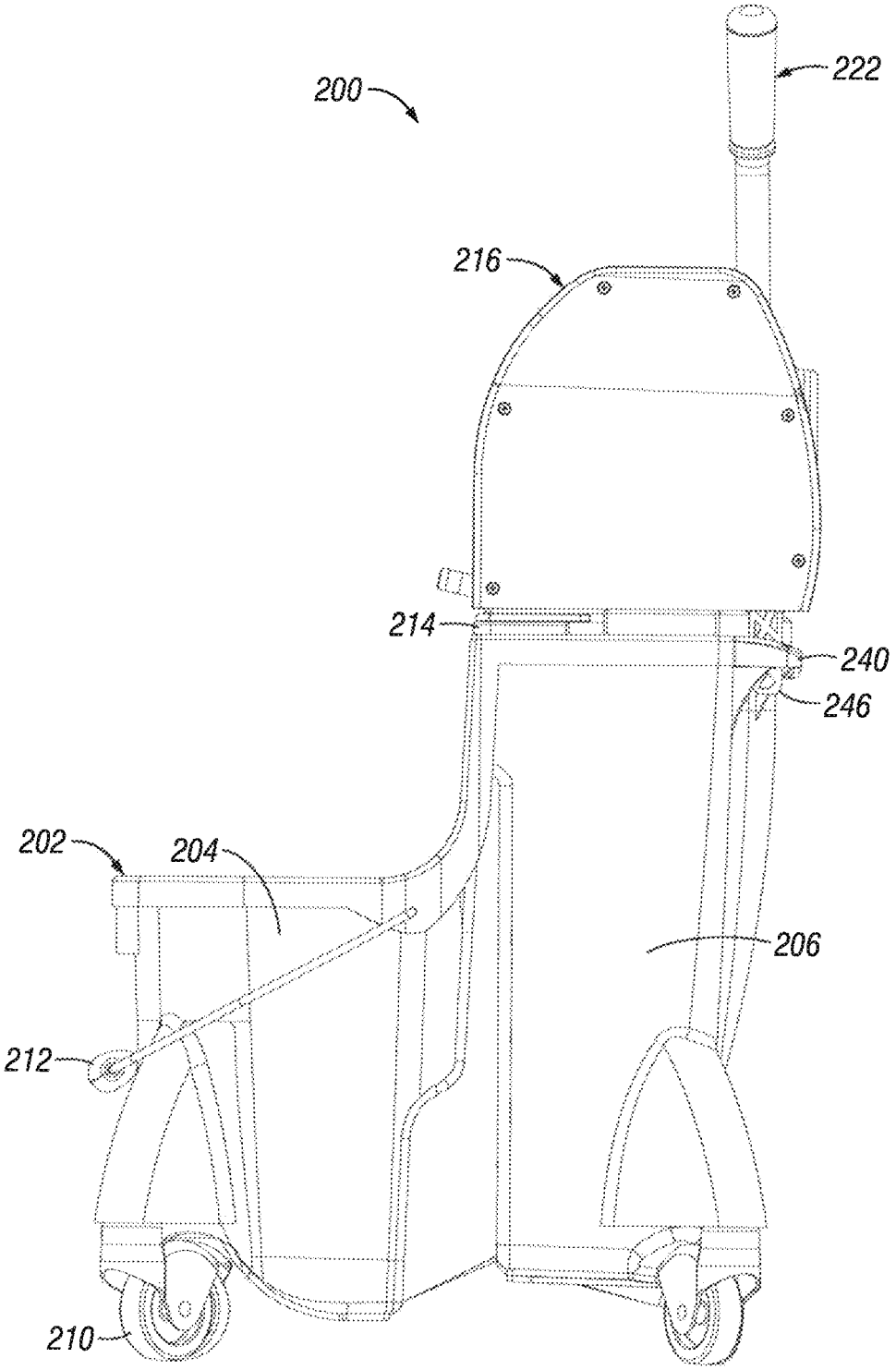
FIG. 26 is a side elevation view of the mop bucket of FIG. 24.
Figure 27:
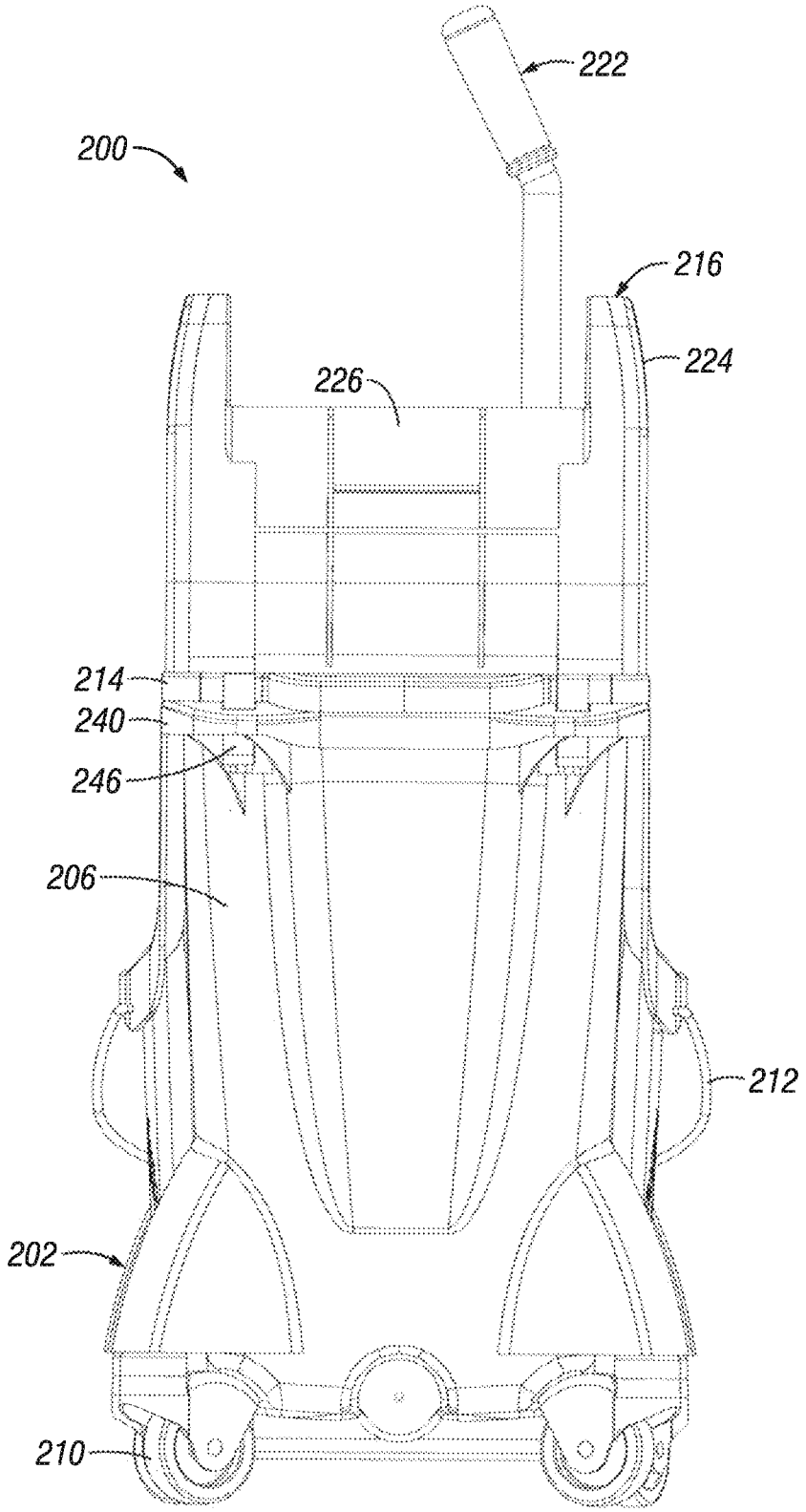
FIG. 27 is a rear elevation view of the mop bucket of FIG. 24.
Figure 28:
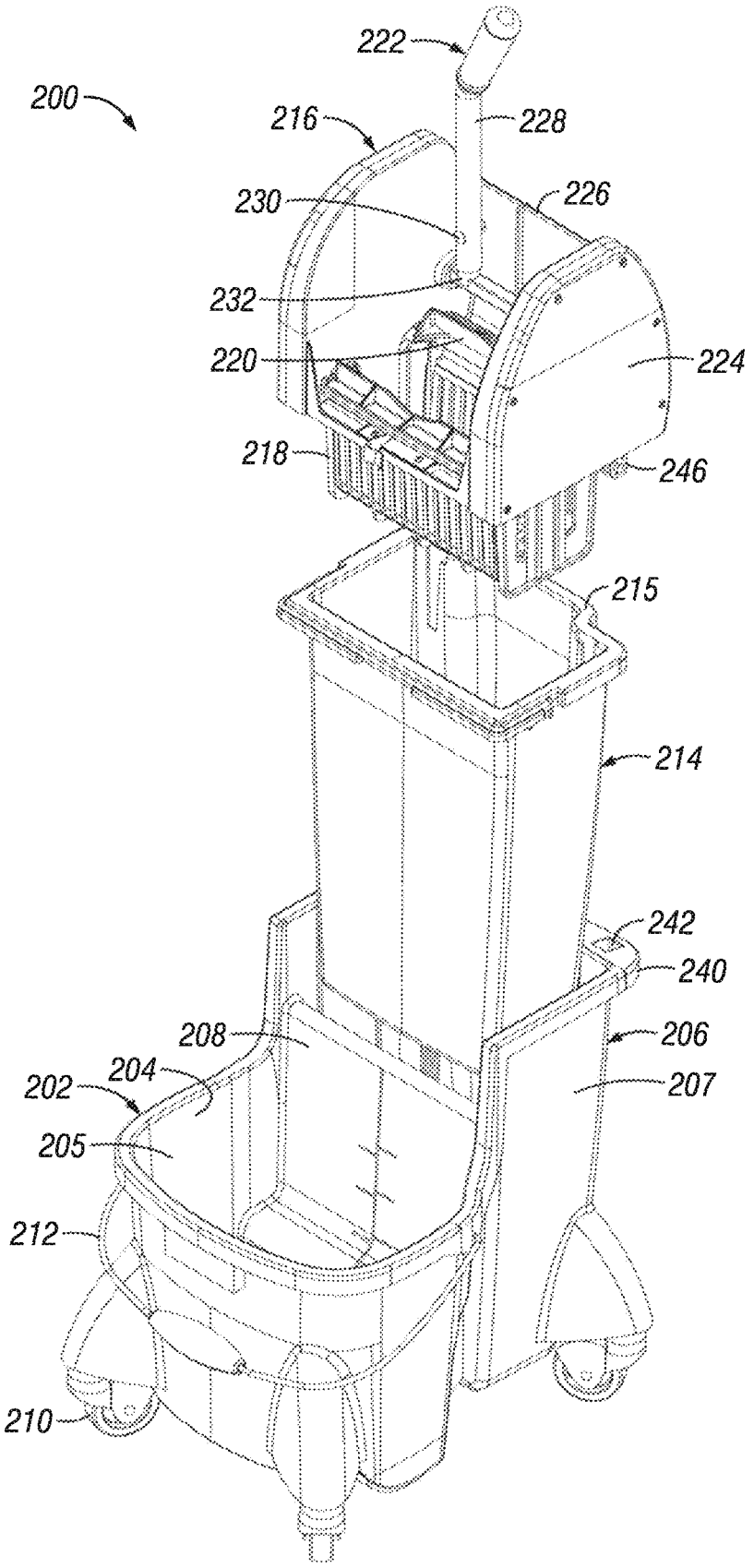
FIG. 28 is an exploded, perspective view of the mop bucket of FIG. 24.
Figure 29:
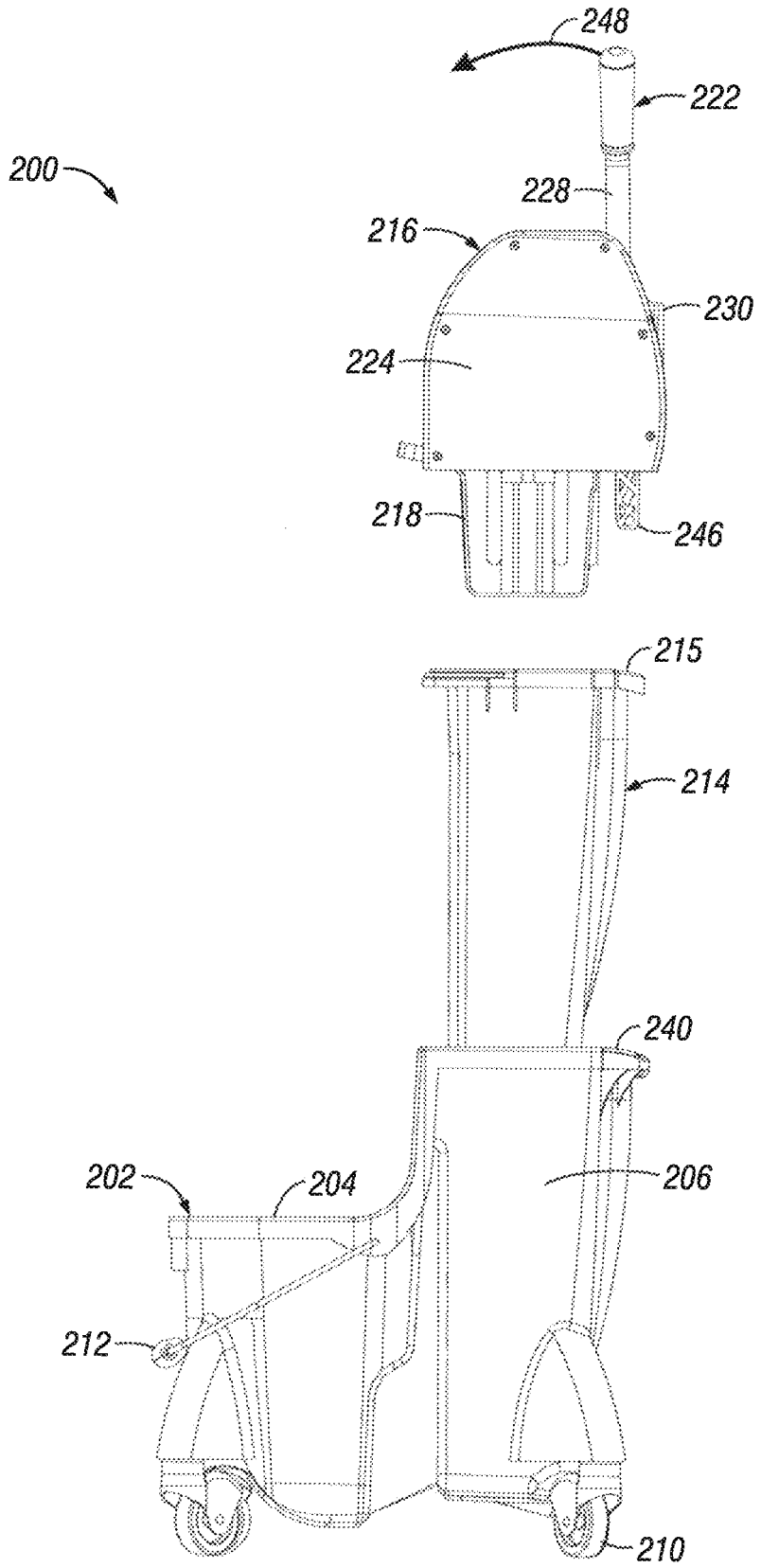
FIG. 29 is an exploded, side view of the mop bucket of FIG. 24.
Figure 30:
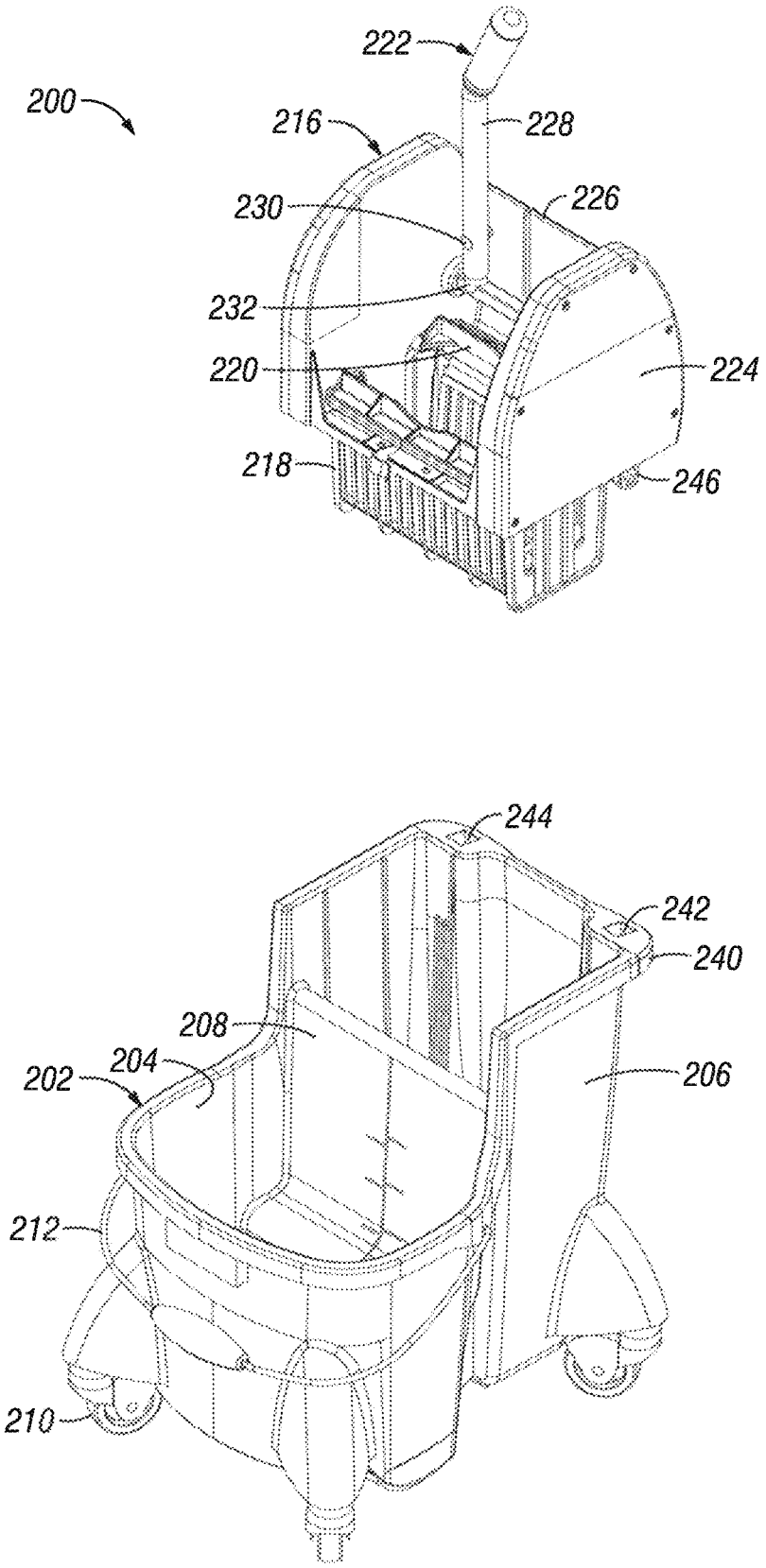
FIG. 30 is an exploded, perspective view showing the mop bucket body and wringer assembly according to aspects of invention.

When the body and cover 80, 84 are attached to one another, the floor care tool 56 can be inserted into the first compartment 14 of the mop bucket 10 containing cleaning solution. This is shown in FIGS. 14-17. As shown in FIGS. 16 and 17, the insert is positioned such that it can be positioned within the sump 50 of the first compartment 14 of the mop bucket 10. The cleaning solution will enter the reservoir 82 of the insert 78. The solution can then be stored until use. When removed from the mop bucket 10, the solution will begin to leak or otherwise be dispensed from the insert 78 via the apertures 88 along the bottom of the tool. These can be sized and positioned such that a desired amount of solution is dispensed from the insert during the cleaning process with the floor care tool 56. Once the solution in the insert 78 has been dispensed, the process can be repeated with the floor care tool and insert inserted into the bucket to receive an additional amount of liquid.

Furthermore, when a traditional mop tool is used to clean, and after use of the liquid with the traditional mop head, the mop head can be positioned within the wringer assembly 26 of the mop bucket 10 to remove excess used liquid from the mop head. The configuration, including the size and orientation of holes in the wringer basket 28 of the wringer assembly 26 will direct the used liquid towards the insert bucket reservoir in the second compartment 16 of the mop bucket 10.

Therefore, as shown in FIGS. 14-17, the use of the floor care tool 56 in relation to the mop bucket is shown. FIG. 7 shows the floor care tool 56 in a stored position such that a portion of the handle 58 of the tool 56 is positioned within the tool hook 38 of the mop bucket 10. This is a storage position wherein the tool 56 may not be in use, and instead wherein the mop bucket is in a ready-to-move configuration.

Also shown in the figures is the floor care 56 with a portion of the tool head in the sump portion 50 of the first compartment 14 of the mop bucket 10. As previously stated, the sump allows the aperture 86 of the attachment cover 84 of the insert 78 to be positioned lower in the first compartment 14 such that it is able to be filled with liquid stored therein, even when the liquid is at a low or lower level. This will provide for more efficiency when using the mop bucket, such that the liquid in the mop bucket will not be wasted.

Therefore, the mop bucket and use thereof has been shown and described, and it has been shown that numerous advantages should be apparent to those skilled in the art. For example, the use of the mop bucket with a floor care tool, such as that shown and described in the figures, will allow for a more efficient cleaning of a floor or other area. The advantages include the use of a sump in a compartment of the mop bucket 10 such that the sump allows for more of a cleaning solution stored therein to be received by a floor care tool for use in cleaning the floor. The use of a shielded wringer assembly 26, which includes holes in a basket to direct water or solution generally downward, also provides for increased efficiency in mitigating spilling or other messes by unwanted liquid on the floor. Still further, the use of a tool hook incorporated as part of the mount bucket provides the efficiency of including a storage location for the floor care tool when not in use, such as during transport of the mop bucket and tool. The hook will allow a floor care tool to be supported on its own.

Additional advantages are included with the cleaning, dispensement, and/or emptying of the mop bucket 10. For example, the inclusion of a spout or spout on a rear location of the second compartment 16 provides for a controlled pouring of the used cleaning solution from the mop bucket. A grip positioned on a lower front wall of the first compartment 14 allows for the user to have a designated space to grip and lift the mop bucket for dispensing of used liquid therefrom.

Furthermore, the inclusion of a sign hanger which is removably attachable to the mop bucket 10 allows for a sign to be hung directly to the mop bucket. The removability of the sign hanger allows for the hanger to be removed during cleaning, dispensing, or otherwise emptying of the mop bucket.

FIGS. 18-23 disclose a mop bucket 100 including yet additional aspects of the invention. The mop bucket 100 is similar to that previously shown and described. For example, it includes a mop bucket body 102 which is separated into a first compartment 104 and a second compartment 106. The first compartment 104 includes upstanding walls 105 forming the compartment, and can include a grip 109 for aid in lifting the bucket 100, such as for dumping the contents of the bucket. The second compartment 106 includes upstanding walls 107 forming said second compartment, and also includes a spout 111. The first and second compartments 104, 106 share a wall 108 positioned generally therebetween. The height of the walls 105, 107, 108 can be varied, but are shown in the figures such that the first compartment has shorter walls than the second compartment.

Additional components of the first compartment 104 include a sump 140 formed in a bottom portion of the reservoir of the first compartment 104. As is shown best in FIG. 22, the sump 140 is positioned in the lower wall or floor of the first compartment reservoir 104 and is shaped differently than the rest of the reservoir. For example, the sump 140 includes a generally vertical wall or section 142 and a curved portion 144. The sump 140 is similar to that previously disclosed. However, as can be seen in the figures, the sump has become narrow in measuring from the vertical section 142 to the curved portion 144. The curved portion 144 is also somewhat steeper than previously disclosed, making for a somewhat deeper measuring to the bottom of the sump 140, which allows for the tool to be positioned lower, which allows the reservoir to be more easily filled with the liquid in the first compartment 104. The sump 140 can be used with the floor care tool 56 as has been previously disclosed, such that the tool is positioned in the sump area to receive an amount of liquid, such as through one or more apertures of the tool insert, so that the liquid is positioned in the reservoir for use in cleaning a floor area.

However, it should be appreciated that the shape of the sump 50, 140, including the depth, width, heights, and/or volume, can all be varied and still be considered part of the invention. The exact configuration of the sump is not to be limiting on the invention, and instead, the ability of the sump to provide a location for utilizing more of the liquid with the cleaning tool is provided.

Still other features of the mop bucket 100 include a plurality of wheels or castors 110 positioned on the underside of the mop bucket body 102 to allow for easy movement of the mop bucket 100. A handle 112 is also included to allow for lifting, moving, dispensing, or otherwise manipulating the mop bucket 100 as required.

Other aspects similar to that previously disclosed includes, but is not limited to, the insert bucket 114 including a spout portion 115 for pouring material therefrom, a wringer assembly 116, a tool hook 128, and a sign hanger 130. As has been previously disclosed, the tool hook 128 and/or hanger 130 can be integral with the bucket 100, or can be removable therefrom. For example, as shown in FIGS. 18-23, the tool hook 128 may be a wire member that is attachable to a portion of the wringer assembly 116, such as by nuts, bolts, screws, adhesive, hook and loops, snaps, or other attachment mechanisms that allow for the removable attachment of the hook 128 to the assembly. In addition, this allows the orientation and other configurations of the hook to be variable. Furthermore, while it is shown that the hook 128 is positioned on the wringer assembly 116, it should be appreciated that it can be positioned generally anywhere in or on the mop bucket 100.

The wringer assembly 116 included in FIGS. 18-23 includes many similar components to that previously disclosed. For example, the assembly 116 includes a wringer basket 118, which may be a mesh bucket. The basket 118 includes slots or other apertures that can be positioned, shaped, or otherwise configured to direct solution from a mop in a downward and/or other directional manner. For example, when the insert bucket 114 is not used, there could be an open space between the basket 118 and the first compartment 104. Therefore, the slots can be configured to direct the solution from a mop toward the sidewalls 124, rear wall 126, and/or in a downward manner so that the used or dirty mop liquid does not reenter the first compartment. The slots can work with the wringer paddle 120 to squeeze out the used liquid from a mop head and to ensure that the used liquid is directed only or substantially into the second compartment 106.

Additionally, as can be seen in the figures, the wringer handle 122 includes a different configuration than that shown in the previous figures. The handle 122 is attachable to a bar 146, which may be a horizontal bar. The handle 122 includes a nub or attachment 148 to allow the handle to be slid along the bar and to be positioned generally anywhere along the length of the bar 146. Furthermore, the handle includes a pivot or rotational point 150, wherein an upper portion of the handle is able to rotate relative to the lower portion that is attached to the bar 146. The handle 122 further includes an upward extending portion 152, which may be substantially vertical, and an angled portion 154 extending from the upward portion 152 ending in a grip portion 156. The angled portion 154 may extend at an angle related to the upstanding portion 152 in an angle which may be in the range of about 30° to about 75°. However, in some embodiments, it may be preferred that the angle be about 45°.

The movability of the attachment point 148 and the rotation of the handle 122 will allow the handle 122 to be configured in numerous configurations. For example, the handle can be slid or otherwise positioned on either the left or right sides of the bar 146 to allow for a user to utilize either hand in operating the assembly 116. The handle could also be positioned in the middle to achieve the greatest torque for operating the paddle 120. Other advantages included with the movement, rotation, and angled configuration of the handle will be apparent, such as the location of the grip, the ergonomic effect, and the increased torqued achievable from the varying configurations of the handle 122.

Furthermore, it is to be appreciated that the movability and the attaching and detaching of the handle 122 allow it to be a modular component. The attachment points can be fixed, such as at each ends of the bar 146 and/or in the middle of the bar, or can be limitless, such that the handle can be positioned generally anywhere along the length of the bar 146.

FIGS. 24-30 show yet additional aspects of a mop bucket 200 according to the disclosure. The mop bucket 200 is similar to that previously shown and described. For example, it includes a mop bucket body 202 which is separated into a first compartment 204 and a second compartment 206. The first compartment 204 includes upstanding walls 205 forming the compartment, and can include a grip for aid in lifting the bucket 200, such as for dumping the contents of the bucket. The second compartment 206 includes upstanding walls 207 forming said second compartment, and also includes a spout 211. The first and second compartments 204, 206 share a wall 208 positioned generally therebetween. The height of the walls 205, 207, 208 can be varied, but are shown in the figures such that the first compartment has shorter walls than the second compartment. Additional components of the first compartment 204 include a sump formed in a bottom portion of the reservoir of the first compartment 204. The sump can take any of the configurations as has been shown and/or described herein.

Still other features of the mop bucket 200 include a plurality of wheels or castors 210 positioned on the underside of the mop bucket body 202 to allow for easy movement of the mop bucket 200. A handle 212 is also included to allow for lifting, moving, dispensing, or otherwise manipulating the mop bucket 200 as required.

Other aspects similar to that previously disclosed includes, but is not limited to, the insert bucket 214 including a spout portion 215 for pouring material therefrom and a wringer assembly 216. A tool hook and/or sign hanger can also be included, but are not required in this or any of the other mop bucket embodiments as shown herein.

The wringer assembly 216 included in FIGS. 24-30 includes many similar components to that previously disclosed. For example, the assembly 216 includes a wringer basket 218, which may be a mesh bucket. The basket 218 includes slots or other apertures that can be positioned, shaped, or otherwise configured to direct solution from a mop in a downward and/or other directional manner. For example, when the insert bucket 214 is not used, there could be an open space between the basket 218 and the first compartment 204. Therefore, the slots can be configured to direct the solution from a mop toward the sidewalls 224, rear wall 226, and/or in a downward manner so that the used or dirty mop liquid does not reenter the first compartment. The slots can work with the wringer paddle 220 to squeeze out the used liquid from a mop head and to ensure that the used liquid is directed only or substantially into the second compartment 206.

The handle 222 includes another configuration in these figures. The handle 222 includes a handle body 228 that can connect to a first or second receiver 232,234 of the wringer assembly 216. The receivers may be positioned for right or left-handed users, and therefore, the bucket 200 can be configured to be used by an operator to best allow them use of the wringer 216. The receivers 232, 234 and handle body 228 can include apertures through which a pin or other retaining member 230 can be inserted to hold the handle body 228 in place for using the wringer 216. The pin 230 can be generally any type of retaining member, such as but not limited to, a clevis pin, dowel, nut and bolt, screw, cotter pin, hair pin, hitch pin, lynch pin, safety pin, snap and lock pin, or generally any other type of fastener, pin, clip, and/or retaining ring for holding the handle body in place. The apertures will aid in aligning the handle body relative to the receiver to provide an ergonomic use of the handle 222 for using the wringer assembly 216.

The use of the wringer assembly 216 will be generally in the direction of the arrow 248. If the handle 222 is rotated in this direction 248 with too much force, the wringer assembly 216 can become separated from either or both of the bucket body 202 and/or the insert bucket 214. Therefore, additional aspects of the embodiment shown include the following. Either or both of the bucket body and the insert, such as shown extending from the second compartment 206 of the bucket body 202 can be a flange 240. The flange can include one or more apertures 242, 244. The wringer assembly 216 can include arms or teeth 246 extending generally downward that are configured to insert into or otherwise communicate with the one or more apertures 242, 244. For example, the arm(s) 246 can simply be inserted into the aperture(s), or can include a friction fit, spring lock, or other member that will lock the arms in place. This will mitigate the separation of the wringer assembly 216 from the rest of the bucket 200 during use of the wringer. The arm(s) will interact with the aperture(s) to hold the wringer assembly 216 in place.

The arm(s) can extend from either the sidewalls 224 or rear wall 226 of the wringer assembly 216, and can take any shape as desired to mitigate the separation of the assembly from the rest of the mop bucket during use. In addition, as disclosed, the arm(s) can include detents, spring locks, nubs, notches, or other features that will interact with the aperture(s) to further aid in holding the wringer assembly in place. Furthermore, as will be appreciated, the bucket body 202 and/or wringer assembly 216 can include as many apertures and arms as desired to hold the components together.

The mop bucket and included components may comprise generally any rigid material. For example, the components may comprise a molded plastic material or other material. The mop bucket body 12, including the first and second compartments, may comprise a singular molded material comprising a one piece body. The additional components can be molded as well and can be connected to one another per their intended use thereof. The bucket 10 and all of the plastic molded parts can comprise polypropylene or polyethylene. Some parts may also comprise a reinforced filler, e.g., nylon, talc, and/or "glass", such as fiberglass. Additional processes can include rotational molding to manufacture the components.

The foregoing description has been presented for purposes of illustration and descriptions, and it is not intended to be an exhaustive list or to limit the invention to the precise forms disclosed. This includes the shapes and sizes of the first and second compartments, as well as the insert bucket and/or wringer assembly. It is contemplated that other alternative processes, systems, and assemblies obvious to those skilled in the art are to be considered part of the invention. It is to be understood that the invention includes numerous advantages, as has been shown and described.

What is claimed is:

1. A mop bucket for containing clean and dirty liquid, comprising: first and second compartments adjacent one another;

said first compartment comprising a front wall, sidewalls, and a sump portion including a recess configured to receive a floor care tool head such that the floor care tool receives clean liquid from the first compartment for use in cleaning a floor;

said sump portion positioned at a lowest point within said first compartment and comprising a vertical portion opposite a curved portion to allow for easier movement of the floor care tool therein;

said second compartment configured to receive dirty liquid from the floor care tool and comprising a rear wall and sidewalls, wherein:

the sidewalls of the second compartment are permanently fixed to the sidewalls of the first compartment;

a dividing wall separates the first and second compartments, the sidewalls of the second compartment have a height greater than a height of the dividing wall; and the height of the dividing wall is greater than a height of the front wall of the first compartment;

an insert bucket within said second compartment, wherein the insert bucket is removable from the second compartment to aid in emptying the dirty water stored therein, and further wherein a height of the insert bucket is larger than the height of the second compartment; and a grip formed as part of a lower edge of an outer wall of said first compartment that aids in lifting the mop bucket for emptying of the mop bucket.

2. The mop bucket of claim 1, further comprising a wringing assembly positioned adjacent the second compartment for use in removing dirty liquid from the floor care tool.

3. The mop bucket of claim 2, wherein the wringing assembly comprises a mesh splash guard to direct the dirty liquid from the floor care tool towards the second compartment.

4. The mop bucket of claim 3, wherein the wringing assembly further comprises a compression member for compressing at least a portion of the floor care tool.

5. The mop bucket of claim 1, further comprising a hanger extending from a portion of the first or second compartment, the hanger configured to receive a portion of a floor sign for use with the mop bucket.

6. The mop bucket of claim 1, further comprising a hook extending therefrom and positioned to receive a portion of a handle of the floor care tool when said tool is positioned in the first compartment.

7. The mop bucket of claim 1, further comprising a rotatable handle to allow for lifting, moving, dispensing, or otherwise manipulating the mop bucket.

8. The mop bucket of claim 1, wherein said second compartment including a spout for pouring the dirty liquid therefrom.

9. A mop bucket for containing clean and dirty liquid, comprising:

a first compartment for containing clean liquid, said first compartment comprising a front wall and sidewalls;

a second compartment for containing dirty liquid, said second compartment having a rear wall and sidewalls, wherein:

the sidewalls of the second compartment are permanently fixed to the sidewalls of the first compartment;

a dividing wall separates the first and second compartments;

the sidewalls of the second compartment have a height greater than a height of the dividing wall; and the height of the dividing wall is greater than a height of the front wall of the first compartment;

said first compartment including a sump recessed in a bottom portion of the compartment and configured to receive a portion of a floor care tool, said sump portion positioned at a lowest point within said first compartment and comprising a vertical portion opposite a curved portion to allow for easier movement of the floor care tool therein;

an insert bucket removably positioned within at least a portion of the second compartment wherein a height of the insert bucket is larger than the height of the sidewalls of the second compartment;

a wringing assembly operatively connected to the insert bucket for directing dirty liquid towards and into the insert bucket; and a grip formed as part of a lower edge of an outer wall of said first compartment that aids in lifting the mop bucket for emptying of the mop bucket.

10. The mop bucket of claim 9, further comprising a hanger extending away from the second compartment for hanging a floor sign therefrom.

11. The mop bucket of claim 9, further comprising a hook member extending at least partially toward the first compartment and configured to receive a handle portion of the floor care tool.

12. The mop bucket of claim 9, further comprising a rotatable handle to allow for lifting, moving, dispensing, or otherwise manipulating the mop bucket.

13. The mop bucket of claim 9, wherein the wringing assembly comprises a mesh basket at least partially within the insert bucket and a compression device configured to direct the dirty liquid towards the mesh basket.

14. The mop bucket of claim 9, wherein said wringing assembly further comprises:

a housing;

a bar rotatably connected to the housing;

first and second paddles operatively attached to the housing and bar such that movement of the bar moves the paddles; and a handle operatively attached to the bar, said handle being positionable at any location along the length of the bar;

said handle comprising a grip portion that is rotatable to allow for varying configurations of the grip portion relative to the bar.

* * * * *